US008276677B2

(12) United States Patent
Ravensbergen

(10) Patent No.: US 8,276,677 B2
(45) Date of Patent: Oct. 2, 2012

(54) COILED TUBING BOTTOM HOLE ASSEMBLY WITH PACKER AND ANCHOR ASSEMBLY

(75) Inventor: John E. Ravensbergen, DeWinton (CA)

(73) Assignee: Baker Hughes Incorporated, Houston, TX (US)

( * ) Notice: Subject to any disclaimer, the term of this patent is extended or adjusted under 35 U.S.C. 154(b) by 295 days.

(21) Appl. No.: 12/626,006

(22) Filed: Nov. 25, 2009

(65) Prior Publication Data

US 2010/0126725 A1 May 27, 2010

Related U.S. Application Data

(60) Provisional application No. 61/118,084, filed on Nov. 26, 2008.

(51) Int. Cl.

| | |
|---|---|
| ***E21B 43/11*** | (2006.01) |
| ***E21B 23/00*** | (2006.01) |
| ***E21B 23/04*** | (2006.01) |
| ***E21B 33/12*** | (2006.01) |
| ***E21B 33/00*** | (2006.01) |
| ***E21B 34/00*** | (2006.01) |

(52) U.S. Cl. ..... 166/387; 166/179; 166/134; 166/316; 166/120; 166/377; 166/382

(58) Field of Classification Search ..... 166/387, 166/377, 55, 297, 117, 118, 177.5, 120, 212, 166/382, 316, 179, 134

See application file for complete search history.

(56) References Cited

U.S. PATENT DOCUMENTS

| | | | | |
|---|---|---|---|---|
| 5,197,547 | A | 3/1993 | Morgan | |
| 5,261,492 | A | 11/1993 | Duell et al. | |
| 5,433,269 | A * | 7/1995 | Hendrickson | 166/134 |
| 5,620,050 | A * | 4/1997 | Barbee | 166/278 |
| 5,813,456 | A | 9/1998 | Milner et al. | |
| 6,244,642 | B1 * | 6/2001 | Serafin et al. | 294/86.17 |
| 6,334,487 | B1 * | 1/2002 | Adkins et al. | 166/55.7 |
| 6,386,292 | B1 | 5/2002 | Bland | |
| 6,481,497 | B2 | 11/2002 | Swor et al. | |
| 6,776,239 | B2 | 8/2004 | Eslinger et al. | |
| 6,926,088 | B2 | 8/2005 | Tinker | |
| 7,004,248 | B2 * | 2/2006 | Hoffman et al. | 166/191 |
| 7,066,265 | B2 | 6/2006 | Surjaatmadja | |
| 7,337,844 | B2 * | 3/2008 | Surjaatmadja et al. | 166/308.1 |

(Continued)

FOREIGN PATENT DOCUMENTS

CA 2342619 A1 9/2000

(Continued)

*Primary Examiner* — David Andrews
*Assistant Examiner* — Michael Wills, III
(74) *Attorney, Agent, or Firm* — Parsons Behle & Latimer

(57) ABSTRACT

A bottom hole assembly (BHA), adapted to be positioned in a casing and to isolate a portion of a wellbore, which includes a packer assembly with a first sealing element extending between first and second portions of the packer assembly. A method of setting a BHA in a casing which includes increasing a BHA pressure to activate an anchor assembly, applying a mechanical force to mechanically deform a first sealing element to thereby establish an initial seal between the first sealing element and an interior surface of the casing, and increasing a pressure in a space between the BHA and the casing and in a cavity within the BHA to increase a differential pressure across the first sealing element and thereby establish a pressure-energized seal between the first sealing element and the interior surface of the casing.

38 Claims, 13 Drawing Sheets

U.S. PATENT DOCUMENTS

| | | | | |
|---|---|---|---|---|
| 7,360,594 | B2 | 4/2008 | Giroux et al. | |
| 7,591,305 | B2 | 9/2009 | Brookey et al. | |
| 7,654,334 | B2 | 2/2010 | Manson | |
| 7,673,693 | B2 | 3/2010 | Standridge et al. | |
| 7,708,062 | B2 | 5/2010 | Carro | |
| 7,878,255 | B2 | 2/2011 | Howell et al. | |
| 8,016,032 | B2 * | 9/2011 | Mandrell et al. | 166/177.5 |
| 2003/0019628 | A1 * | 1/2003 | Ravensbergen et al. | 166/308 |
| 2007/0051521 | A1 * | 3/2007 | Fike et al. | 166/387 |
| 2007/0074873 | A1 * | 4/2007 | McKeachnie et al. | 166/376 |
| 2007/0151735 | A1 * | 7/2007 | Ravensbergen et al. | 166/308.1 |
| 2008/0271898 | A1 * | 11/2008 | Turley et al. | 166/382 |
| 2008/0308282 | A1 * | 12/2008 | Standridge et al. | 166/387 |
| 2010/0155052 | A1 | 6/2010 | Manson | |

FOREIGN PATENT DOCUMENTS

| | | | |
|---|---|---|---|
| CA | 2322075 | A1 | 4/2001 |
| CA | 2390133 | A1 | 5/2001 |
| CA | 2397460 | A1 | 8/2001 |
| CA | 2156982 | C | 1/2002 |
| CA | 2434346 | A1 | 1/2004 |
| CA | 2514492 | A1 | 2/2004 |
| CA | 2447308 | A1 | 4/2004 |
| CA | 2489063 | A1 | 6/2005 |
| CA | 2565137 | A1 | 10/2005 |
| CA | 2535940 | A1 | 8/2006 |
| CA | 263100 | A1 | 3/2007 |
| CA | 2634561 | A1 | 12/2008 |
| CA | 2726207 | A1 | 12/2009 |
| CA | 2693676 | A1 | 7/2010 |
| CA | 2713611 | A1 | 1/2011 |
| CA | 2709759 | A1 | 3/2011 |
| CA | 2738907 | A1 | 7/2011 |
| CA | 2740684 | A1 | 1/2012 |

* cited by examiner

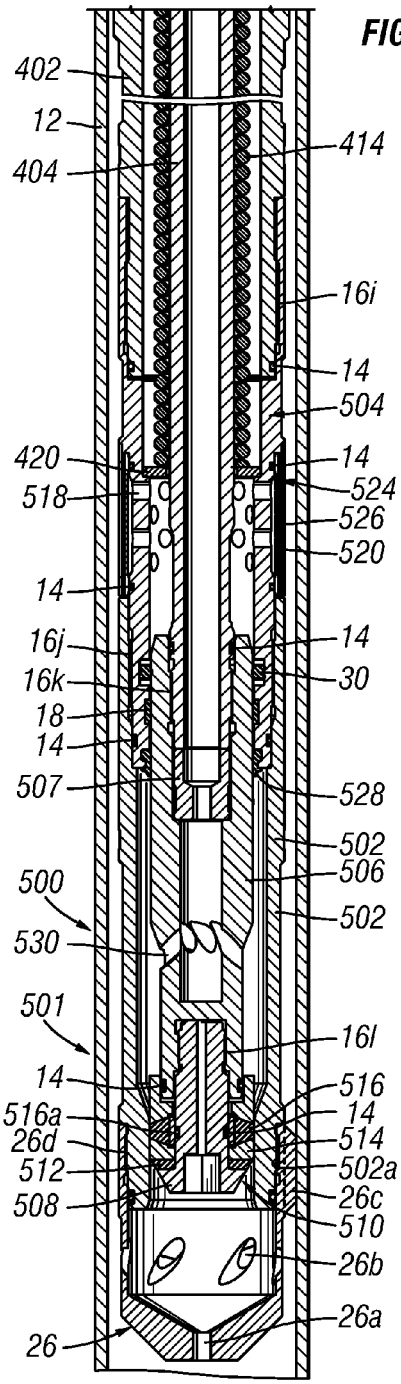
FIG. 3C
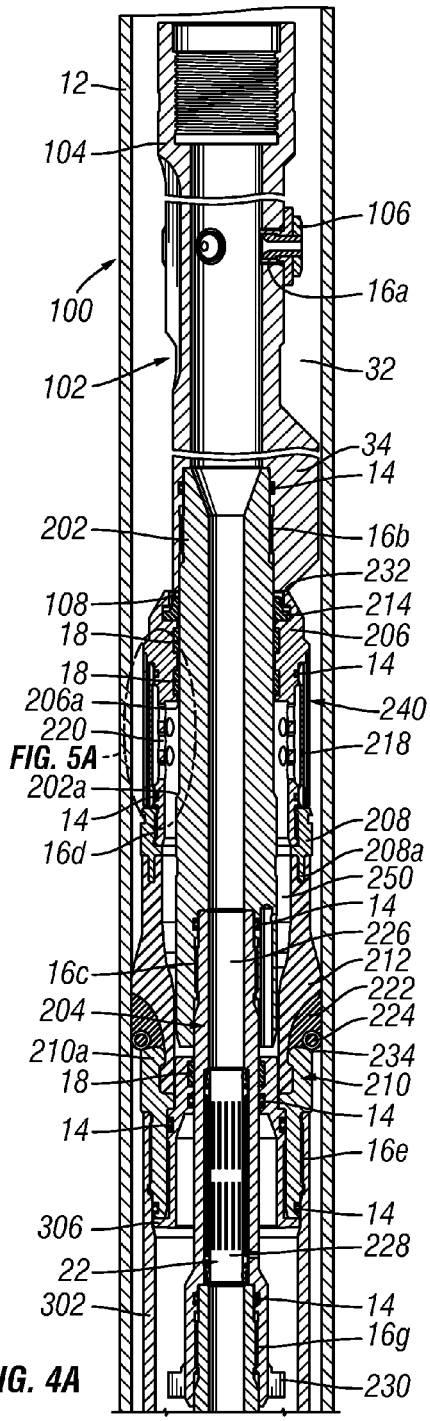
FIG. 5A
FIG. 4A

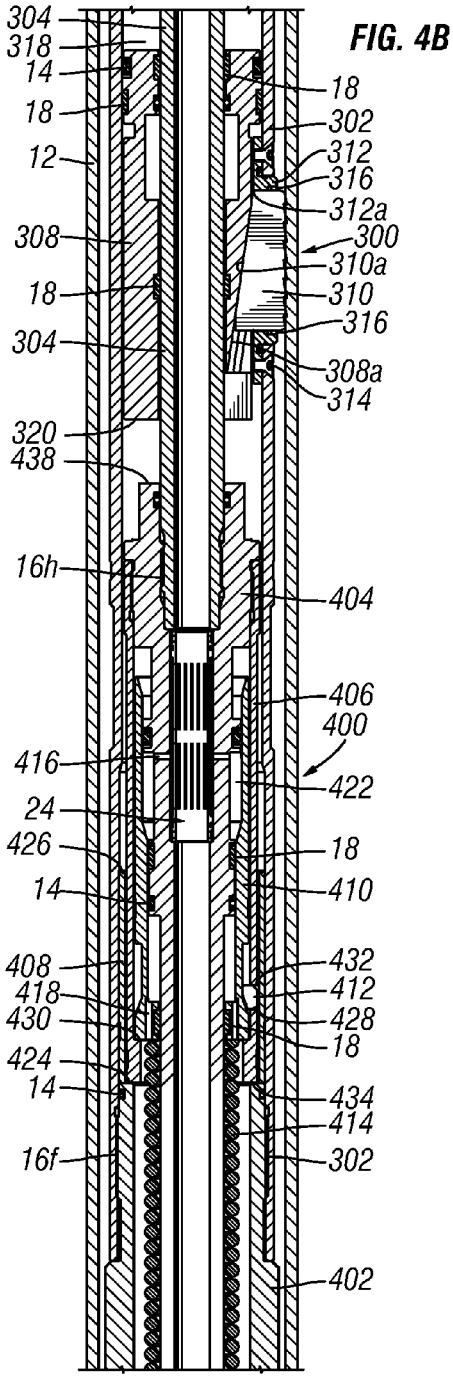
FIG. 4B
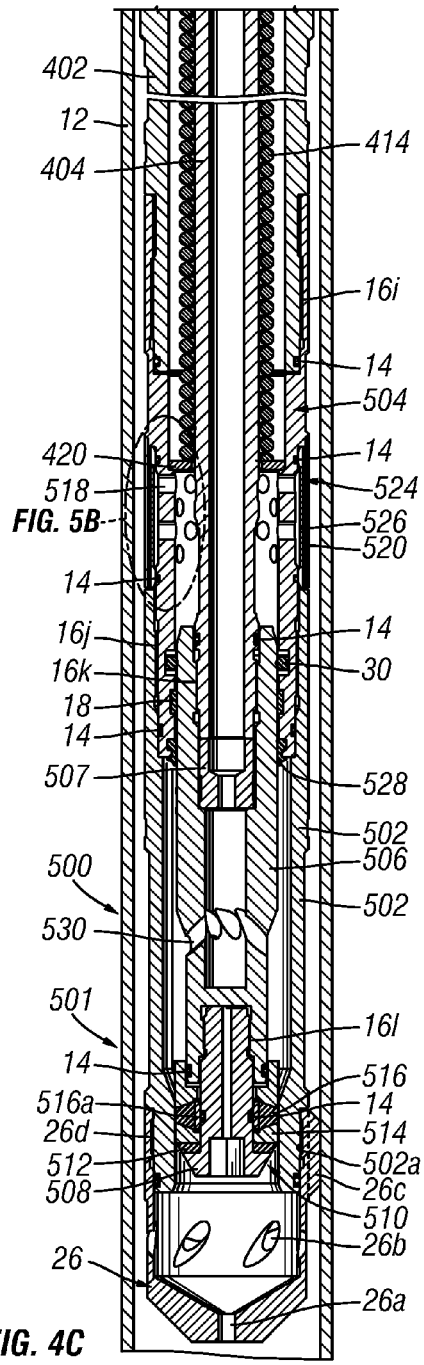
FIG. 5B
FIG. 4C

COILED TUBING BOTTOM HOLE ASSEMBLY WITH PACKER AND ANCHOR ASSEMBLY

RELATED APPLICATIONS

The present disclosure claims benefit of U.S. Provisional Patent Application No. 61/118,084, filed on Nov. 26, 2008, the disclosure of which is hereby incorporated by reference in its entirety.

BACKGROUND

1. Field of the Disclosure

The present disclosure is generally directed to a downhole tool for use in oil and gas wells, and more specifically, to a coiled tubing bottom hole assembly with a packer and an anchor assembly for use in oil and gas wells containing solid-laden fluids. The packer and anchor assembly is particularly useful for isolating portions of a wellbore prior to fracturing oil and gas wells with coiled tubing.

2. Description of the Related Art

Perforating and fracturing operations have long been performed in completing oil and gas wells for production. Generally, perforating involves forming openings through the well casing and into the formation, by commonly known devices such as a perforating gun or sand jet. Thereafter, the perforated zone may be hydraulically isolated and fracturing operations are performed to increase the size of the initially-formed openings in the formation. Proppant materials are introduced into the enlarged openings in an effort to prevent the openings from closing.

More recently, techniques have been developed whereby perforating and fracturing operations are performed with a coiled tubing string. One such technique is known as the Annular Coil Tubing Fracturing Process, or the ACT-Frac Process for short, disclosed in U.S. Pat. Nos. 6,474,419, 6,394,184, 6,957,701, and 6,520,255, each of which is hereby incorporated by reference in its entirety. To practice the techniques described in the aforementioned patents, the work string, which includes a bottom hole assembly (BHA), must remain in the well bore during the fracturing operation(s). Performing proppant fracturing operations with coiled tubing presents many unique challenges.

One challenge of performing fracturing operations with coiled tubing is due to the small clearances between the BHA and the casing. Because of the small clearances, it is possible for the BHA to become wedged in the casing. Further, proppant used for fracturing may also lead to the BHA getting stuck within the wellbore. A stuck BHA poses significant problems to any perforating and fracturing operation because of the resulting lost time and expensive specialized machinery and operating crews needed to retrieve the BHA.

Another challenge of performing fracturing operations with coiled tubing may be attributable to the relatively low strength of the coiled tubing. As stated above, a BHA may have a propensity to get stuck within a casing. Because only limited pulling forces are available through coiled tubing, it might not be possible to pull a stuck BHA out using coiled tubing. Also the use of coiled tubing may present problems in setting the BHA within the wellbore. Typically in the prior art, a packer and anchor assembly is anchored in a casing by applying an axial mechanical force through the work string to the packer assembly. However, coiled tubing cannot be used to transmit large axial forces, so such anchoring operations may be less effective if axial forces through the work string are required. Because of the limited axial mechanical force that may be applied with coiled tubing, it may be preferred to use an anchoring system to anchor a coiled tubing BHA that may be actuated through the application of hydraulic pressure. Conventional pressure set anchor systems are typically button type anchors, which may not adequately secure the BHA while properly centering the packing element, as discussed below.

One particularly critical component in coiled tubing fracturing applications is the packer element of the BHA, which is employed to hydraulically isolate a portion of the wellbore. The packer assembly typically comprises some mechanism to seal against the interior of the casing such that one zone within the well may be isolated from another zone or zones, within the well. For example, during high pressure fracturing operations, it is necessary to isolate a target zone of the well such that the high pressure fracturing fluids may be introduced only into that zone of the well.

There are different types of sealing elements commonly employed in treating oil and gas wells. A first type is a squashable sealing element, for example the type used in compression set or tension set packers, wherein a seal element is deformed by an axial compressive force such that it sealingly engages the inside of the casing. One potential problem with the use of traditional compression set packers in coiled tubing applications is that, when such packers are employed, there is a very small radial clearance between the outside diameter of the packer assembly and the inside diameter of the casing. For example, for a casing with a 4 inch inside diameter, the unset outside diameter of the compression set packer is typically 3.771 inches. Such close clearance is ideal to minimize the extrusion gap between the packer assembly and the inside diameter of the casing. If compression set packers are intended for high pressure and temperature applications, permanently deformed back up rings can be used, however they further decrease the extrusion gap. The small radial clearance can present problems when trying to remove the BHA as discussed in detail below.

The use of proppants and/or cross linked gels in the fracturing fluid may increase the chance that the BHA becomes stuck in the wellbore due to the small clearances between the BHA and the casing. In addition, the sealing elements in such compression set packers do not readily return to their original shape or size, or do so at a slow rate. This further reduces the radial clearance between the packer assembly and the casing. The relatively small clearance required by squashable sealing elements makes them potentially problematic for coiled tubing fracturing applications, as the packer is more likely to become stuck in the well.

Additionally, squashable sealing elements generally require large forces to axially compress the sealing element to sealingly engage the casing. These large setting forces can be more easily attained with jointed pipe as compared to coiled tubing. Some strategies can be employed to enable the use of squashable set packers with coiled tubing; however, in some applications coiled tubing cannot be relied upon to generate the required forces to set the squashable sealing element. Therefore, because of the small clearances and large axial forces generally required to set a squashable sealing element, squashable sealing elements may not be acceptable for use in various coiled tubing applications.

Another broad category of packers are known as inflatable packers. In general, such packers have an inflatable member that is inflated to achieve the desired seal. Although such inflatable packers may have a relatively large clearance (e.g., 4" ID casing, 3.125-3.5 OD packer), such inflatable packers may suffer from other potential problems.

One particular type of inflatable packer is a slat type packer that comprises an inner inflatable member, a plurality of metal slats and an outer cover member. In solid laden fluid or slurry applications, such slat type packers may get sand, proppant, and/or other solids in the various layers of the packer. When this occurs, the packer may not return to its original shape and size when it is deflated, or it may take a longer time to return to its original size and shape.

Another type of inflatable packer is generally known as a cord-type packer. This type of packer employs a unitary body comprised of an inner tube member, a plurality of cords for mechanical strength, and an outer cover. Although penetration of sand, proppant or other solids is not a concern with this type of an inflatable packer, a cord-type packer typically does not exhibit good recovery of its original shape in all applications. Complete recovery of the inflatable elements of inflatable packers is a problem in general, particularly when such packers are subjected to repeated use under elevated temperatures and pressures typically experienced in a well. Such lack of complete recovery may increase the chances of the tool getting stuck in the well.

One shortcoming of both squashable and inflatable type sealing elements is the inability to return to their original diameter after multiple sets. The rubber sealing element, after unsetting, retains a larger outer diameter than it had prior to expansion, resulting in a greater chance that the BHA may become stuck in the casing. In addition, these packers do not revert back to their original size and shape immediately or even rapidly. It is a common practice in the industry to wait several minutes, for example 15 minutes, after unsetting a rubber seal element in the BHA before attempting to move the BHA, to allow enough time for the rubber sealing element to pull away from the casing inner surface and revert to a smaller size to reduce the chance that the BHA will become stuck. This waiting period reduces the overall productivity of perforating and fracturing operations.

The anchor assembly is a component of a BHA used in the ACT-Frac Process. During the fracturing process, the large pressure differential on the set packer exerts a large force on the set anchor assembly. The anchor assembly when set is designed to be able to withstand this large force and retain the BHA at the set location during the ACT-Frac Process. Anchor assemblies are often set using large axial forces to move slips up a set of cones force the slips radially out to bite into and set the assembly against the casing. The setting of slips on corresponding cones may be helpful to center the BHA within the casing, which is important to ensure a uniform extrusion gap, as discussed herein. A large axial force may be needed to adequately set the slips against the casing. As discussed above, the ACT-Frac Process employs coiled tubing, which has a relatively low strength limiting the axial force that may be used to set slips of the anchor assembly. Thus, it would be beneficial to provide an anchor assembly that sets centers and adequately sets a BHA within a casing without the need of a large axial force.

In general, any packer assembly of a coiled tubing BHA is subject to inherent weaknesses of the coiled tubing. That is, coiled tubing cannot transmit large amounts of axial forces to the packer and anchor assembly, and cannot be used to rotate the BHA relative to the casing. In addition, the number of instances coiled tubing can be used to transmit forces at a determined depth is limited due to its low cycle fatigue life. Thus, it is desirable to reduce the likelihood that the packer assembly will cause the BHA to become stuck within the wellbore. Further, it may be beneficial to minimize the application of axial load to set the packer and/or the anchor. It would also be beneficial to provide a packer assembly for a BHA that had sufficient wellbore clearance in the unset state and that may be repeatedly set and unset with the packer rapidly returning close to its unset diameter providing sufficient wellbore clearance.

The present disclosure is directed to an apparatus for solving, or at least reducing the effects of, some or all of the aforementioned problems.

SUMMARY OF THE DISCLOSURE

The following presents a summary of the disclosure in order to provide an understanding of some aspects disclosed herein. This summary is not an exhaustive overview, and it is not intended to identify key or critical elements of the disclosure or to delineate the scope of the invention as set forth in the appended claims.

One embodiment of the present disclosure is a BHA that includes a mandrel, a housing, a packer, and an anchor assembly. The housing of the BHA may be moved with respect to the mandrel between a first position and a second position. The anchor assembly is connected to the housing and includes a plurality of slips adapted to selectively secure the BHA within a well casing and also center the BHA within the casing. The plurality of slips are retained in a retracted position while the housing is in the first position and the plurality of slips move to an outward or extended position while the housing moves to the second position with respect to the mandrel. The packer is also connected to the housing and includes a first annular sealing element, a second annular sealing element connected to the first annular sealing element, and a spring embedded within the second annular sealing element. After the BHA has been secured to the casing by the anchor assembly, downward movement of the mandrel engages the first annular sealing element with the casing. Fluid pressure may be applied to then engage the second sealing element with the casing. The sealing element may have an expansion ratio, as defined herein, of at least 1.15.

The housing of the BHA is initially retained in the first position relative to the mandrel and may be selectively released to permit the plurality of slips of the anchor assembly to move to the outward position. The housing may be selectively released from the first position by the application of a predetermined amount of fluid pressure.

The anchor assembly may include an anchor piston connected to the mandrel with the anchor piston having inclined surfaces that correspond to an inclined surface on each of the anchor slips. The inclined surfaces of the anchor piston may be optimized to adequately secure the BHA to the casing while allowing a limited amount of upward axial force to disengage the slips from the casing. For example, the inclined surfaces may provide a 1:7 ratio of vertical force to horizontal force due to the inclined surfaces being oriented at an angle of approximately 8.13 degrees relative to the well-bore axis.

In one illustrative embodiment, a BHA is disclosed that is adapted to be connected to coiled tubing and positioned within a casing having an internal diameter. The BHA includes a perforating assembly with a fluid path in communication with the coiled tubing, a packer assembly, an anchor assembly, a release assembly, and a valve assembly.

The packer assembly includes an upper packer mandrel connected to the perforating assembly and having a fluid path in communication with the fluid path of the perforating assembly. The packer assembly includes a packer filter housing slidably connected to the upper packer mandrel with the packer filter housing including flow ports in communication with an annulus between the coiled tubing and an internal surface of the casing. The packer assembly also includes a lower packer mandrel connected to the upper packer mandrel with the lower packer mandrel having a fluid path in communication with the fluid path of the upper packer mandrel. The packer assembly includes a lower packer crossover member, a first annular sealing element, and a second annular sealing element. The first annular sealing element is connected to both the packer filter housing and the lower packer crossover member, wherein a downward movement of the packer filter housing with respect to the lower packer crossover member engages the first annular sealing element with the internal diameter of the casing to create an initial seal. The second annular sealing element is connected to both the first annular sealing element and the lower packer crossover member and includes an embedded spring Annular pressure may communicate through the flow ports of the packer filter housing causing the first and second sealing elements to engage the internal surface of the casing to pressure-energize the initial seal.

The anchor assembly may be repeatedly moved between a set position and an unset position, and includes an anchor housing connected to the lower packer crossover member. The anchor assembly also includes an anchor mandrel that is axially slidable within the anchor housing. The anchor assembly also includes a plurality of anchor slips extendable from the anchor housing.

The release assembly is adapted to selectively retain the anchor in the unset position and may release the anchor to move into the set position by an increase in pressure within the BHA to a predetermined amount. The valve assembly is connected to the release assembly.

The second annular sealing element may have a harder durometer measurement than the first annular sealing element. The second annular sealing element and the embedded spring may prevent extrusion of the first annular sealing element below the second annular sealing element. Each anchor slip may have an outwardly-facing casing-engaging surface and an inclined surface. The anchor assembly may further include a plurality of anchor bushings defining openings in the anchor housing and being radially distributed around the anchor housing. Each anchor slip may be located inside an anchor bushing. The anchor assembly may include an anchor piston slidably connected to the anchor mandrel. The anchor piston may include a plurality of inclined surfaces corresponding to and abutting against the plurality of inclined surfaces on the anchor slips. The anchor assembly may be adapted to actively centralize the BHA within the casing.

The release assembly may further include a spring housing connected to the anchor housing, a spring shaft connected to the anchor mandrel, a release housing, at least one release segment, a release sleeve, a release piston, a spring ring adjacent to the spring housing, and a spring. The release housing may be connected to the spring shaft and may have at least one release segment opening. The at least one release segment may have a plurality of tapered surfaces and may be adapted to prevent axial movement of the spring housing relative to the spring shaft while the plurality of release segments are located within the release segment openings. The release sleeve may be connected to the spring housing and may have a tapered end corresponding to the plurality of release segment tapered surfaces. The release sleeve tapered end may be adapted to urge the plurality of release segments out of the release segment openings when an upward force is applied to the release sleeve. The release piston may radially surround the spring shaft and may be slidable within the release housing and may have at least one release segment recess. The spring may be coiled around the spring shaft and may be disposed between the release piston and the spring ring.

The valve assembly may include a valve seal within a valve bore. The valve seal may be adapted to form a seal with the valve bore in response to a downward force applied through the coiled tubing.

The valve assembly may further include a valve housing connected to a main filter housing connected to the release assembly spring housing, a valve mandrel connected to a release assembly spring shaft, a main orifice positioned in a cavity formed in the valve mandrel, a valve cap screw connected to the valve mandrel, and a valve seal assembly connected to the valve mandrel and the valve cap screw. The valve seal assembly may include at least one valve backup ring and a valve seal.

In another illustrative embodiment, a BHA is disclosed that includes an anchor assembly, a release assembly, and a valve assembly. The anchor assembly is adapted to be set within the casing by fluid pressure and mechanically unset from the casing. The release assembly is adapted to selectively retain the unset anchor assembly and release the anchor assembly upon an increase in fluid pressure to a predetermined amount. The valve assembly may include a valve cap screw and a first and second backup ring. The valve cap screw may be positioned distally from the valve seal, the valve seal may be positioned distally from second backup ring, and the second backup ring may be positioned distally from the first backup ring. The first backup ring may have a harder durometer measurement than the second backup ring. The second backup ring may have a harder durometer measurement than the valve seal.

In another illustrative embodiment of the present disclosure, a BHA is disclosed that includes a plurality of anchor slips, each anchor slip located within an anchor bushing and having a radially inward-facing inclined surface, an anchor housing, an anchor piston located inside the anchor housing an upper packer mandrel, and a lower packer mandrel. The anchor piston has at least one radially outward-facing inclined surface, wherein each inclined surface abuts a corresponding radially inward-facing inclined surface of an anchor slips. The anchor housing may be adapted to move axially relative to the anchor piston in response to an increased fluid pressure within the casing. The plurality of anchor slips may be adapted to extend from the anchor bushings in a radially outward direction in response to an axial movement of the anchor housing relative to the anchor piston. The anchor slips may be adapted to centralize the BHA within the casing when the anchor slips are extended from the anchor bushings.

The upper packer mandrel may be adapted to move downhole, toward the lower packer mandrel, in response to an applied downward mechanical force, thereby causing the first annular sealing element to deform in a radially outward direction, engaging a casing internal surface and establishing an initial seal with the casing.

In yet another illustrative embodiment, a method of isolating a portion of a wellbore is disclosed. The method includes positioning a BHA at a depth within a casing, activating an anchoring mechanism of the BHA by increasing a pressure differential within the BHA, and creating a seal against an interior surface of the casing by applying an axial mechanical force to the BHA. Increasing the pressure differential within the BHA may be accomplished by increasing a fluid flow rate within coiled tubing. Increasing the fluid flow rate may remove debris from between a BHA sealing element and an inner surface of the casing. The method may include performing a perforating operation on the interior surface of the casing after creating the seal against the interior surface of the casing by applying an axial mechanical force to the BHA. Activating the anchoring mechanism may include increasing the pressure within the BHA to drive an anchor housing in an axial direction and extending a plurality of anchor slips in a radially outward direction to engage with the interior surface of the casing in response to the axial movement of the anchor housing. Extending the plurality of anchor slips in a radially outward direction to engage with the interior surface of the casing may center the BHA within the casing. Creating a seal within the casing may include applying a mechanical force in a downhole direction onto the BHA to deform a first annular sealing element in an outward direction thereby engaging the interior surface of the casing, forming an initial seal with the casing and further increasing the pressure differential across the seal to pressure-energize the first annular sealing element, thereby pressure-energizing the initial seal. Extending the plurality of anchor slips may be triggered by increasing the pressure within the BHA. The method may further include disengaging the anchoring mechanism and releasing the seal. Disengaging the anchoring mechanism may include decreasing the pressure within the BHA. Disengaging the anchoring mechanism may include providing a mechanical force in an uphole direction to the BHA. Releasing the seal may include decreasing the pressure within the BHA.

In another illustrative embodiment, a method of setting a BHA within a casing is disclosed. The method includes increasing a pressure within a BHA to drive an anchor housing in a axial direction, extending a plurality of anchor slips in a radially outward direction to engage with an interior surface of the casing, thereby centering the BHA within the casing and anchoring the BHA to the casing, applying a mechanical force in a downhole direction onto the BHA, deforming a first annular sealing element in an outward direction, engaging the first annular sealing element with the interior surface of the casing, thereby forming an initial seal with the interior surface of the casing, increasing the pressure differential across the seal, and pressure-energizing the first annular sealing element, thereby pressure-energizing the initial seal. The application of the mechanical force in a downhole direction may close a valve within the BHA preventing fluid flow out of the end of the BHA. After the fracturing process is complete, the method may include the application of a mechanical force in an uphole direction to open the valve equalizing the pressure differential across the annular sealing element.

Another embodiment of the present disclosure is a sand slurry valve that includes a housing, a mandrel, and a seal assembly connected to the mandrel. A portion of the housing includes a seal bore and the mandrel is movable within the housing such that the seal assembly may be positioned within the seal bore. The seal is adapted to provide a seal when positioned within the seal bore. The mandrel includes a flow passage that has been adapted to provide rotational fluid flow through the housing prior to the seal assembly being moved into the seal bore. The seal assembly may include a seal, a first backup ring, and a second backup ring with the second backup ring being positioned between the seal and the first backup ring. The rotational flow through the housing may help to protect the seal from being damaged by particles carried within the flow. The materials used in the components of the seal assembly may also be configured to protect the sealing element from damage due to particles within the housing. The first backup ring may have a harder durometer measurement than the second backup ring, which may have a harder durometer measurement than the sealing element. The first backup ring may be a thermoplastic, the second backup ring may be a fiber-filled Teflon, and the sealing element may be an elastomer.

BRIEF DESCRIPTION OF THE DRAWINGS

This disclosure may be understood by reference to the following description taken in conjunction with the accompanying drawings, in which like reference numerals identify like elements, and in which:

FIGS. 3A-3C depict the BHA during the initial setting of the packer assembly;

FIGS. 4A-4C depict the BHA wherein the packer assembly is in its fully set position;

Figure 1A:
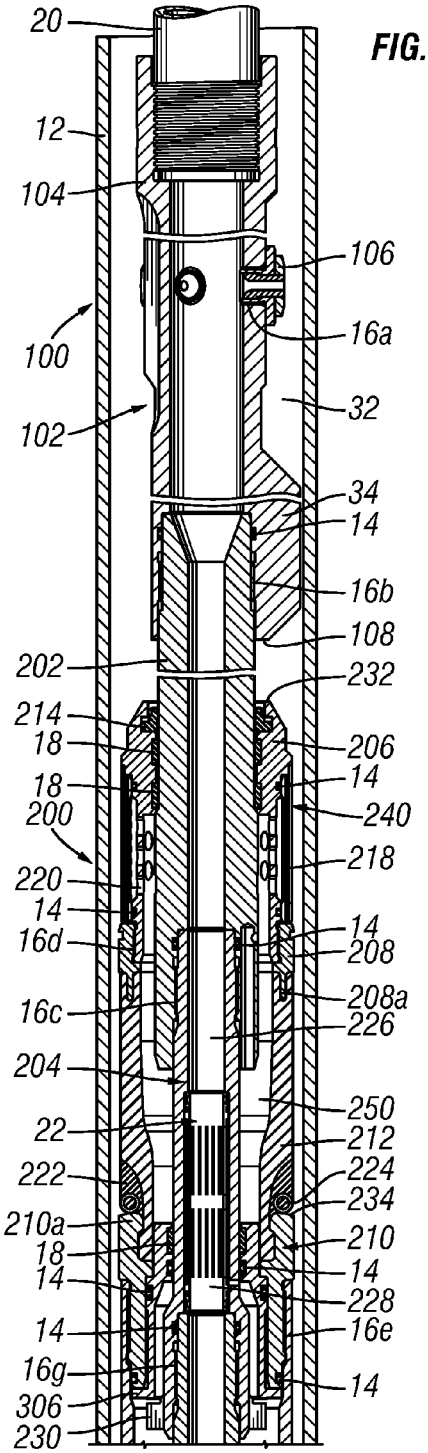
FIGS. 1A-1C depict one illustrative embodiment of a BHA with an anchor and a packer assembly in its initial run-in condition.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the disclosure as defined by the appended claims.

DETAILED DESCRIPTION

Illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

The attached figures depict an illustrative BHA in accordance with one illustrative aspect of the subject matter disclosed herein positioned in a casing 12. In general, the illustrative BHA depicted herein comprises a perforating assembly 100, a packer assembly 200, an anchor assembly 300, a release assembly 400 and a valve assembly 500. In use, the BHA, particularly the perforating assembly 100, will be coupled (directly or indirectly) to an illustratively depicted coiled tubing string 20 such that the coiled tubing string 20 is in fluid communication with the BHA. In some applications, various devices (not shown) may be positioned between the coiled tubing string 20 and the BHA. For example, a check valve assembly (dual flapper valve), a release tool, a burst disk or other well-known downhole components may be positioned above the illustrative perforating assembly 100. The use and structure of such additional devices are well known to those skilled in the art. Accordingly, further details of such additional devices are not provided so as not to obscure the present disclosure.

As will be understood by those skilled in the art after a complete reading of the present disclosure, the perforating assembly 100 disclosed herein may be employed with a variety of different perforating, fracturing and treatment devices. For example, an illustrative sand jet perforating assembly 102 comprising a sand jet housing 104 and a plurality of sand jet nozzles 106 may be employed with the perforating assembly 100 described herein. In one illustrative embodiment, the sand jet perforating assembly 102 may comprise three illustrative sand jet nozzles 106, although other configurations are possible, as will be understood by those skilled in the art. Alternatively, the perforating assembly 100 disclosed herein may be employed with other types of perforating assemblies, e.g., perforating guns. The perforating assembly further comprises a plurality of rigid centralizers 34. Alternatively, the rigid centralizers 34 disclosed herein may be located on other assemblies that make up the BHA. For example, rigid centralizers 34 may be located on the packer assembly 200.

Figure 5B:
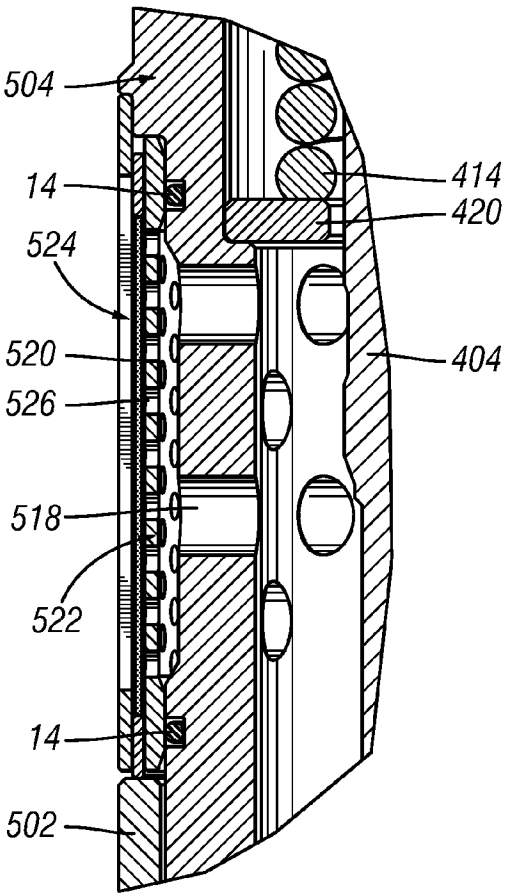
FIGS. 5A-5B are enlarged cross-sectional views of an embodiment of a filter that may be employed with the BHA described herein.
Figure 5A:
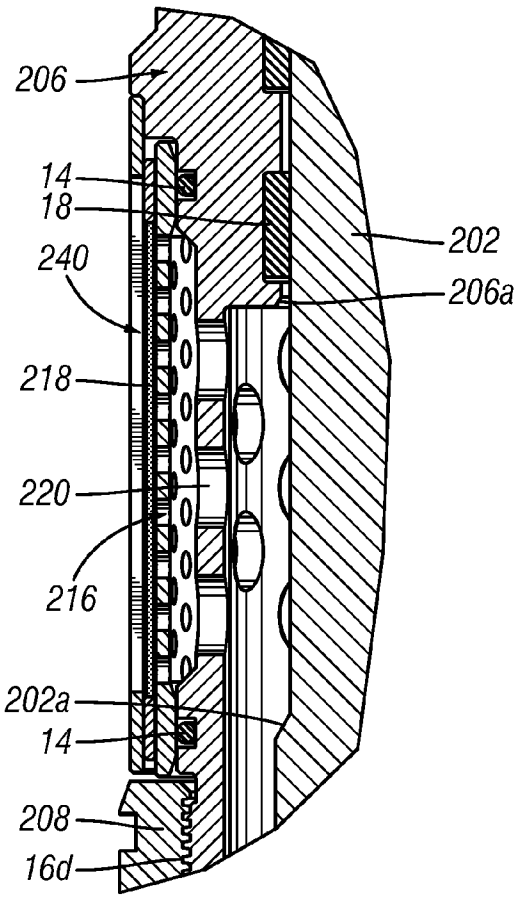

A packer assembly 200 is connected below the perforating assembly 100. Alternatively a component, such as a subhousing, or multiple components could be connected between the packer assembly 200 and the perforating assembly 100. In the depicted embodiment, the packer assembly 200 comprises an upper packer mandrel 202, a lower packer mandrel 204, a packer filter housing 206, a packer top ring 208, a packer lower crossover 210 and a sealing element comprising a soft rubber element 212 positioned between the packer top ring 208 and the packer lower crossover 210. The packer assembly 200 further comprises a packer wiper 214, a plurality of wear rings 18, a packer screen 216 (shown in FIG. 5A), a packer filter 218 and a slotted outer cover 240. A plurality of openings 220 are formed in the packer filter housing 206. The sealing element further comprises a hard rubber element 222 with an embedded spring 224. FIG. 5A is an enlarged view of the packer filter 218 and associated structure. As described more fully below, the hard rubber element 222 and the spring 224 act as anti-extrusion devices to insure that the soft rubber element 212 does not extrude in a downhole direction through the annular space 32 between the casing 12 and the packer assembly 200. The upper packer mandrel 202 comprises a fluid passageway 226 in communication with the coiled tubing 20 via the perforation assembly 100. The lower packer mandrel 204 includes a fluid passageway 228 in communication with the fluid passageway 226 of the upper mandrel. An upper internal filter 22 is positioned within the lower packer mandrel 204. The lower packer mandrel 204 also comprises an extended flange 230 adjacent the lower end of the lower packer mandrel 204.

The soft rubber element 212 may be made of any material sufficient to perform the functions described herein for such a seal during perforating and fracturing operations. In one illustrative embodiment, the soft rubber element 212 and hard rubber element 222 may be a seal, such as, for example, a nitrile seal or highly saturated nitrile ("HSN") seal manufactured by Rubber Atkins, Ltd. of Aberdeen, Scotland. The soft rubber element 212 may be similar to the seal elements depicted in U.S. Pat. Nos. 7,308,945 or 7,380,592, each of which is hereby incorporated by reference in their entirety. The hard rubber element 222 has a hardness that is greater than the hardness of the soft rubber element 212. In one illustrative embodiment, the hard rubber element 222 may be comprised of a material having a hardness greater than approximately 95 durometer. The hard rubber element 222 may be comprised of a variety of materials, e.g., nitrile; hydrogenated nitrile rubber ("HNBR"); and VITON, which is made by Dupont, as would be appreciated by one of ordinary skill in the art having the benefit of this disclosure. A spring 224 may be embedded into the hard rubber element 222. The spring 224 may also be any type of spring sufficient to perform the function described herein for the spring 224. In one illustrative embodiment, the spring 224 is a garter spring with a radius roughly equivalent to an extrusion gap radius. The purpose of the hard rubber element 222 is to prevent the soft rubber element 212 from extruding into an annular cavity between the BHA and the casing 12 while the soft rubber element 212 is under a high pressure differential. The purpose of the spring 224 is to assist the soft rubber element 212 and the hard rubber element 222 to rapidly return to their original sizes and shapes after they have disengaged from sealing against the casing 12. In order to provide a sealing element with adequate clearances from the casing 12, the sealing element 212 and spring 224 can be centralized within the casing 12 due to a large extrusion gap. The large extrusion gap helps to ensure adequate clearance between the BHA and the casing as the BHA is ran into the casing. If the spring 224 is not properly centered, the sealing element 212 may not adequately isolate the fracturing zone when set. The spring 224 can also be maintained close to concentric to ensure an adequate seal. For example, if the spring 224 is eccentric by even a small amount, possibly as little as 1/16th of an inch, the sealing elements 212 and 222 may not form a strong seal which may lead to complete seal failure, which may result in the BHA becoming stuck in the casing.

One advantage of the present disclosure is that the seal may be set with a small axial force. Typically, packer seals are set with axial force provided through a mandrel within a wellbore. As discussed above, coiled tubing does not typically permit the application of a large set down force. The above referenced Rubber Atkin's seal design discloses using pressure to energize or set the sealing element. The current embodiment of the BHA is adapted to initially set a seal 212 of the packer assembly 200 with a small axial set-down force with coiled tubing 20. The soft rubber element 212 provides an initial seal with the casing 12 in response to the small axial set-down force, permitting the operator to pump fluid down the casing or coiled tubing and increase the fluid pressure within the casing 12. This increased pressure then fully sets the packer assembly 200, pushing out the hard rubber element 222 and spring 224 against the casing 12 as well as completely energizing the soft rubber element 212, pushing the soft rubber element 212 into full engagement with the casing 12. As discussed above, the hard rubber element 222 prevents the extrusion of the sealing element 212 due to increases in pressure especially at elevated temperatures. The spring 224 provides a restoring force to return the hard rubber element 222 and the soft rubber element 212 back to their relaxed sizes and shapes even against a pressure differential of up to 500 psi. The restoring force of the spring 224 may be varied according to the application of the sealing element.

Figure 1B:
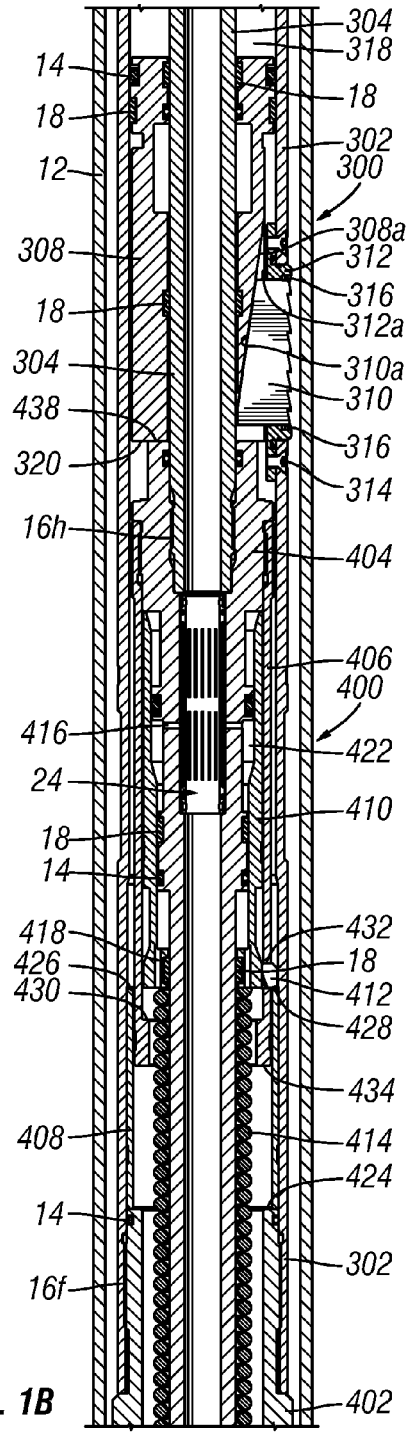

The illustrative anchor assembly 300 shown in FIGS. 1A-1B herein comprises an anchor housing 302, an anchor mandrel 304 and an anchor top bulkhead 306. The anchor assembly 300 further comprises an anchor piston 308 and a plurality of anchor slips 310, each of which are positioned in an anchor bushing 312. In the illustrative example depicted herein, the anchor assembly 300 comprises three illustrative anchor slips 310. Also, the illustrative anchor bushings 312 may be comprised of nitronic 50 stainless steel, an aluminum nickel bronze alloy, or various other materials as would be appreciated by one of ordinary skill in the art having the benefit of this disclosure. The anchor bushings 312 may be secured to anchor housing 302 by a plurality of recessed fasteners 314, e.g., screws. In one particular illustrative embodiment, the anchor slips 310 may be approximately one inch in width and three inches in length. Of course, depending upon the particular application, the number, size, shape and location of the anchor slips 310 may vary as would be appreciated by one of ordinary skill in the art having the benefit of this disclosure. Thus, the particular illustrative examples depicted herein should not be considered a limitation of the present disclosure. The anchor slips 310 and the anchor mandrel 304 may be made of a variety of different materials, depending upon the particular application. In one illustrative embodiment, the anchor slips 310 may be made of steel, e.g., AISI 8620, while the anchor piston 308 may be made of an alloy, e.g., Alloy 630 (Al Ni Bz).

The anchor assembly 300 benefits from being pressure-activated. As discussed in more detail below, the anchor slips 310 extend to engage the casing 12 in response to increasing pressure of a circulating fluid within the BHA. After the sealing element of the BHA has engaged the casing, an increase in pressure within the casing increases the force with which the slips 310 bite in the casing. For example, as the pressure is increased, such as during a fracturing process, the differential pressure on the packer provides a downward force on the anchor piston 308 causing the anchor slips 310 to bite with increased force into the casing. Thus, the BHA of the present disclosure may be set with only minimal axial force, instead primarily relying on an increased circulating fluid pressure to activate the packer and anchoring assemblies 200, 300.

As will be discussed in more detail below, one benefit of the anchor assembly 300 is active centralization, wherein the anchor slips 310 apply a centering force to the BHA to maintain the BHA in an axial center of the casing. The active centralization feature of this disclosure permits use of the BHA in different weight of the same size of casing (for example, the same anchor assembly 300 described herein may be employed in 9.5-15.1 lb/ft 4" casing having an inside diameter of 4.090" and 3.826", respectively). The active centralization also provides that the packer assembly 200 remains centered within the casing thus ensuring that the sealing elements 212, 222, and spring 224 are substantially concentric within the casing 12 when set. Ensuring that the packer assembly 200 remains centered within the casing provides a substantially even extrusion gap around the circumference of the sealing elements.

The illustrative release assembly 400 depicted herein comprises a spring housing 402, a spring shaft 404, a release housing 406, a release sleeve 408, a release piston 410, a plurality of release segments 412, a spring 414 and a lower spring ring 420. A plurality of fluid passageways 416 are provided in the spring shaft 404. A plurality of fluid passageways 418 may be provided in the release piston 410 to ensure low pressure cannot exist in this cavity when the release piston 410 moves rapidly. A lower internal filter 24 is positioned within the spring shaft 404. The spring constant of the spring 414 may vary depending upon the particular application. In one illustrative embodiment, the spring 414 may have a spring constant of approximately 26 lbs/in. The number, size and configuration of the release segments 412 may vary depending upon the particular application. In one illustrative embodiment, the BHA comprises three release segments, each of which have an arcuate width of approximately ten degrees.

Figure 6A:
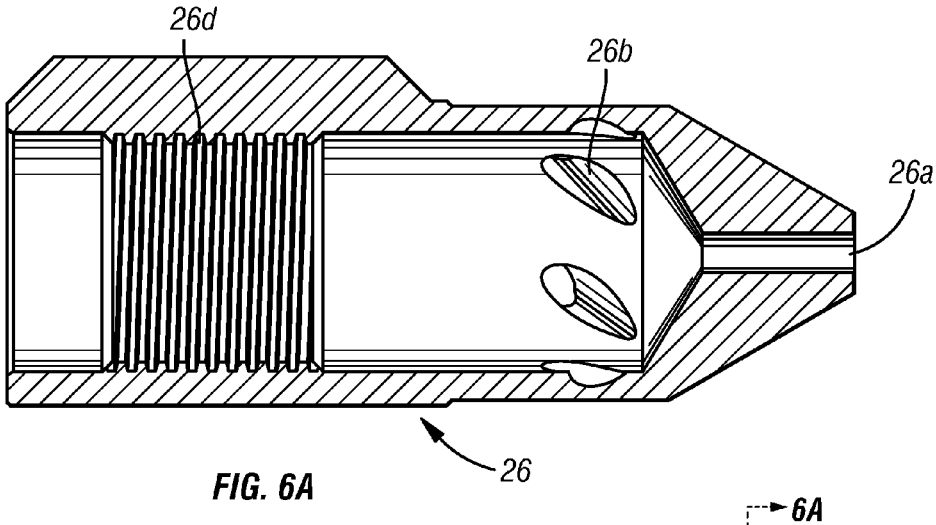
FIGS. 6A-6C depict various views of an embodiment of an end cap that may be employed with the BHA described herein.
Figure 6B:
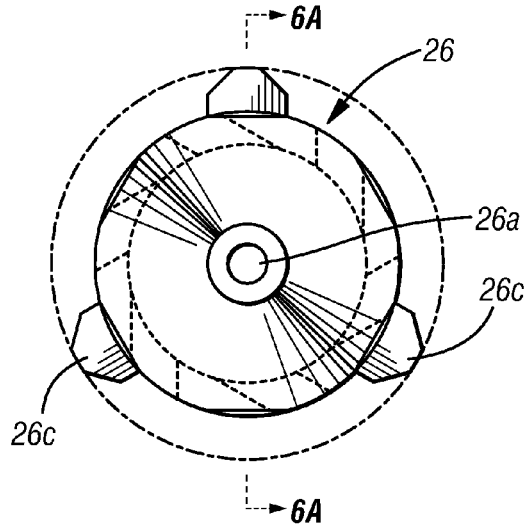
Figure 6C:
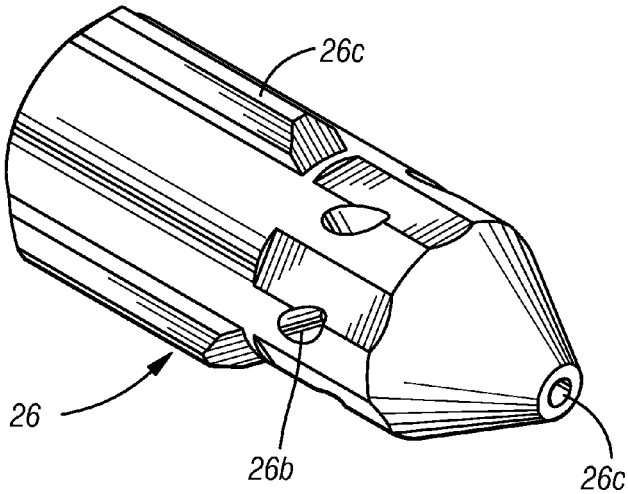
Figure 7A:
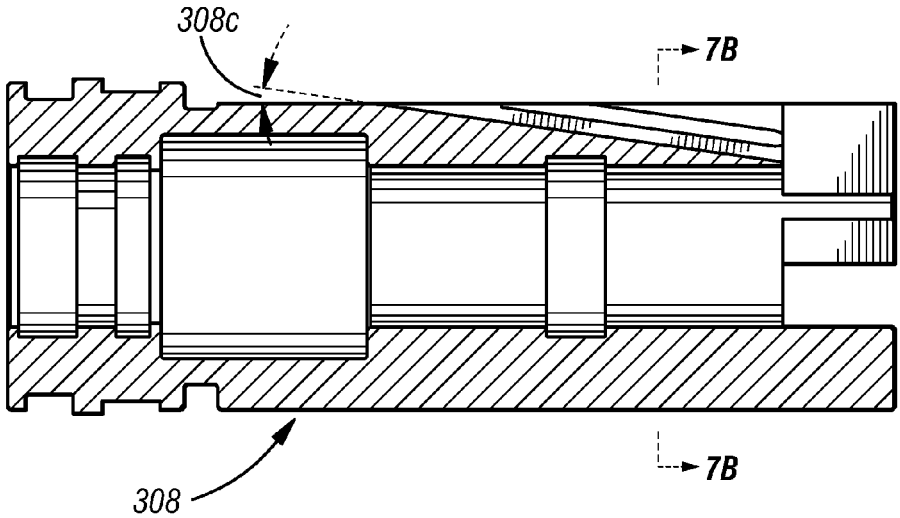
FIGS. 7A-7C are various views of an embodiment of an anchor piston that may be employed with the BHA described herein.
Figure 7B:
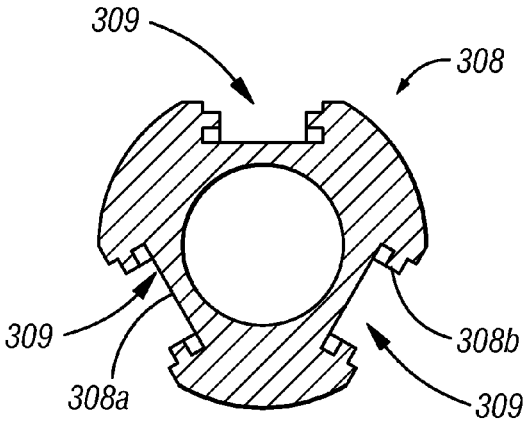
Figure 7C:
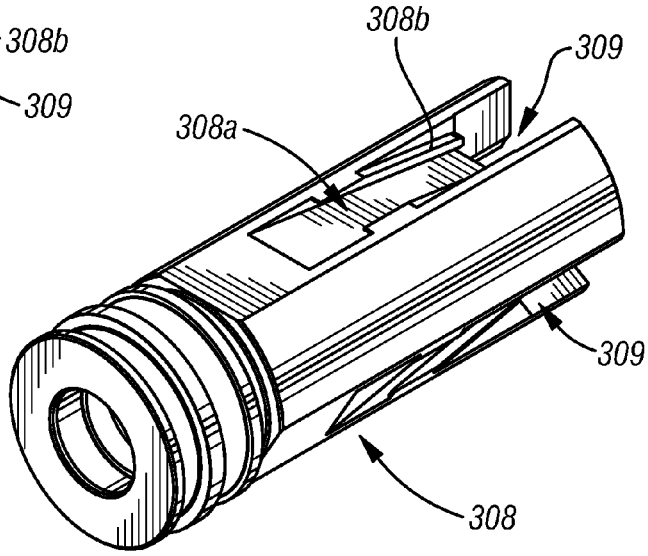
Figure 8A:
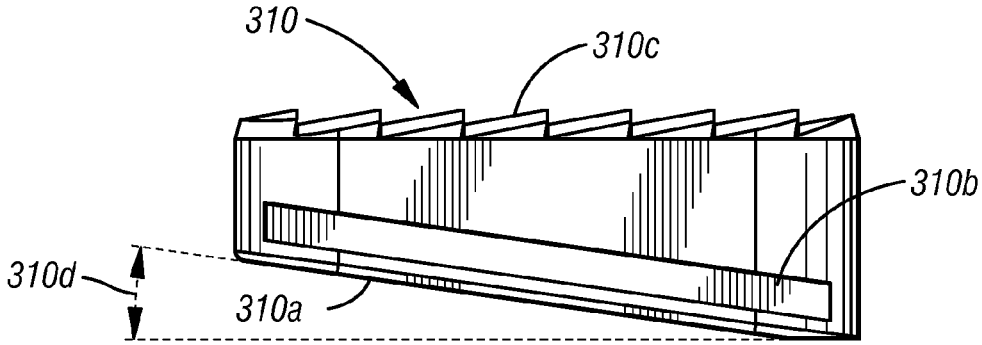
FIGS. 8A-8C are various views of an embodiment of an anchor slip that may be employed with the BHA described herein.
Figure 8B:
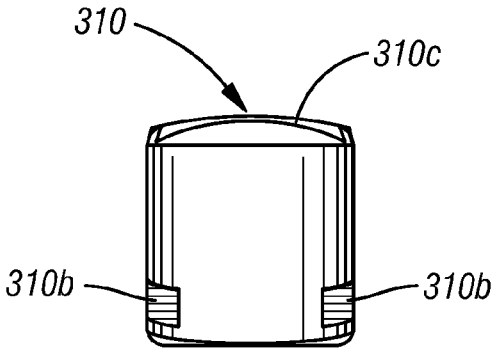
Figure 8C:
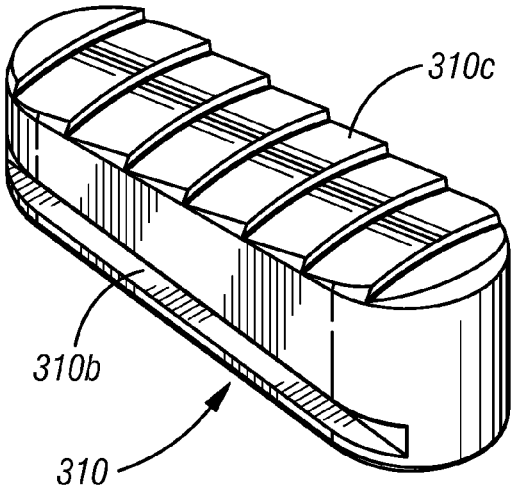

The illustrative valve assembly 500 depicted herein comprises a valve 501, a valve housing 502, a main filter housing 504, a valve mandrel 506, a main orifice 507, a valve cap screw 508 and a valve seal 510. In the illustrative example depicted herein, the valve seal 510 comprises a first valve backup ring 512, a second valve backup ring 514 and a valve seal 516. The main filter housing 504 comprises a plurality of openings 518. Also attached to the main filter housing 504 is a filter 520, a screen 522 and a slotted outer cover 524. The screen 522 has a plurality of openings 526 formed therein. The slotted outer cover 524 has an opening formed therein. FIG. 5B is an enlarged view of the filter 520 and associated structures. A plurality of flow openings 518 are formed in the main filter housing 504. A plurality of flow openings 530 are formed in the valve mandrel 506. The flow openings 530 provide centrifugal rotation to fluid flowing there through which tends to protect the valve seals from particles that may be in the fluid. In an alternative embodiment, vanes (not shown) positioned at outlets of the flow openings 530 could be provided to provide rotation to the fluid. In one illustrative embodiment, an illustrative end cap 26, as depicted in FIGS. 6A-6C, may be coupled to the distal end of the valve housing 502. As shown therein, the illustrative end cap 26 comprises a central flow opening 26*a*, a plurality of radial side flow openings 26*b* and a plurality of ribs 26*c*. Threads 26*d* are also provided such that the end cap 26 may be threadingly coupled to the threads 502*a* on the valve housing 502. Of course, as will be recognized by those skilled in the art after a complete reading of the present disclosure, components other than the illustrative end cap 26 depicted herein may be used. For example, other components such as a memory module that includes one or more memory gauges may be coupled to the end of the BHA if desired or needed for a particular application.

The various components of the BHA may be assembled by making various mechanical attachments, e.g., threaded connections. In the illustrative embodiment disclosed herein, the illustrative sand jet nozzles 106 may be threadingly coupled to the sand jet housing 104 by threaded connections 16*a*. The upper packer mandrel 202 is threadingly coupled to the sand jet housing 104 and the lower packer mandrel 204 by the threaded connections generally identified by the reference numbers 16*b*, 16*c*, respectively. The packer filter housing 206 is threadingly coupled to the packer top ring 208 by the threaded connection generally identified by the reference number 16*d*. The soft rubber element 208 is bonded to the projection 208*a* of the packer top ring 208 and to a portion 210*a* of the packer lower crossover 210. The hard rubber element 222 is also bonded to the portion 210*a* of the packer lower crossover 210. The spring 224 is embedded in the hard rubber element 222 during manufacturing of the hard rubber element 222. The packer lower crossover 210 is threadingly coupled to the anchor housing 302 by the threaded connection 16*e*. The anchor housing 302 is threadingly coupled to the spring housing 402 via threaded connection 16*f*. The anchor mandrel 304 is threadingly coupled to the lower packer mandrel 204 and the spring shaft 404 via threaded connections 16*g*, 16*h*, respectively. The spring housing 402 is threadingly coupled to the anchor housing 302 and the main filter housing 504 by threaded connections 16*f*, 16*i*, respectively. The main filter housing 504 is also threadingly coupled to the valve housing 502 via threaded connection 16*j*. The spring shaft 404 is threadingly coupled to the valve mandrel 506 via threaded connection 16*k*. The valve cap screw 508 is threadingly coupled to the valve mandrel 506 by threaded connection 16*l*. The upper internal filter 22 is positioned in a cavity in the lower packer mandrel 204 and retained therein by the anchor mandrel 304. The lower internal filter 24 is positioned in a cavity in the spring shaft 404 and retained therein by the anchor mandrel 304. The main orifice 507 is positioned in a cavity formed in the valve mandrel 506 and it is retained therein by the spring shaft 404.

Various seals, wear rings and wipers are provided at various locations throughout the BHA. In the illustrative BHA depicted in the drawings, illustrative o-ring seals 14 may be provided at the depicted locations between the various components. The nature and construction of the seals 14 may vary depending upon the anticipated service conditions for the BHA and the particular components to be sealed together. In an illustrative example depicted herein, the seals 14 are traditional o-ring seals with Teflon back-up rings.

Various wear rings 18 may also be provided as depicted in the illustrative BHA to provide wear protection and to assist in properly centering the various components of the BHA, which may reduce sliding friction. The wear rings 18 may be of traditional construction and materials. Of course, the size, location and materials of construction for the wear rings 18, as well as other components of the BHA, may be modified depending upon the particular application.

FIGS. 7A-7C and 8A-8C are, respectively, enlarged views of various aspects of the anchor piston 308 and the anchor slips 310. In the illustrative embodiment depicted herein, the anchor piston 308 is provided with three recesses 309, each of which is adapted to receive an anchor slip 310. The recesses 309 are provided with inclined surfaces 308*a* that are adapted to engage the inclined surfaces 310*a* on the anchor slips 310. The anchor piston 308 also comprises elongated projections or rails 308*b* that are adapted to cooperate with slots 310*b* formed in the anchor slips 310. In one illustrative embodiment, the inclined surfaces 308*a* as well as the elongated rails 308*b* are oriented at an angle 308*c* of approximately 8.13 degrees (1:7 ratio) relative to a well-bore axis.

The anchor slips 310 comprise a plurality of teeth 310*c* for engaging the casing 12. The anchor slips 310 also comprise a plurality of elongated slots 310*b* that are adapted to receive and cooperate with the elongated projections or rails 308*b* formed in the recesses 309 of the anchor piston 308. The inclined surfaces 310*a* and the slots 310*b* are also formed at an angle 310*d* of approximately 8.13 degrees so that they may cooperate with the inclined surfaces 308*a* and elongated projections 308*b*, respectively, of the anchor piston 308. Each of the anchor slips 310 is movable radially outward through the opening 312*a* formed in the anchor bushing 312 based upon interaction between the inclined surfaces 308*a*, 310*a* when relative movement is provided between the anchor piston 308 and the anchor slip 310, as described more fully below. A wiper 316 is provided on the anchor bushing 312 so as to remove debris from the anchor slip 310 as it moves within the opening 312*a*. When the anchor assembly 300 is unset from the casing 12, the anchor slips 310 are forcibly moved from the expanded position (shown in FIG. 2B) to a retracted position (shown in FIG. 1B). The downward movement of the housing assembly, discussed in detail below, moves the slips 310 down off of the anchor piston 308 in comparison to conventional anchor assemblies that typically use springs to return the slips to the retracted position. The movement of the housing assembly to forcibly retract the slips helps to ensure that the slips are moved to retracted position by the unsetting procedure.

Figure 9:
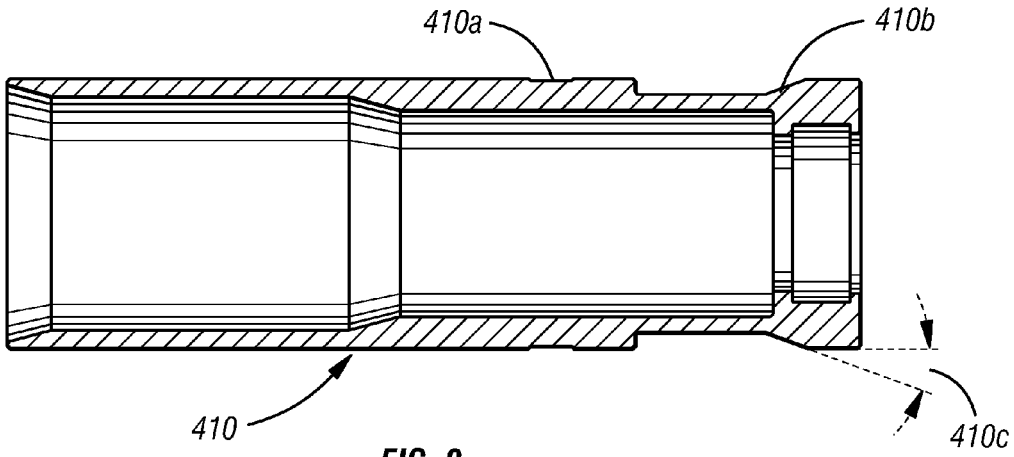
FIG. 9 depicts an enlarged cross-sectional view of the embodiment of a release piston described herein.
Figure 10A:
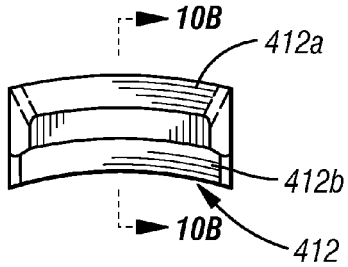
FIGS. 10A-10C depict various views of the embodiment of a release segments 412 disclosed herein.
Figure 10B:
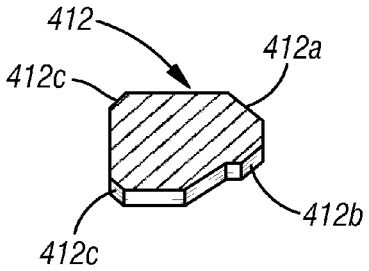
Figure 10C:
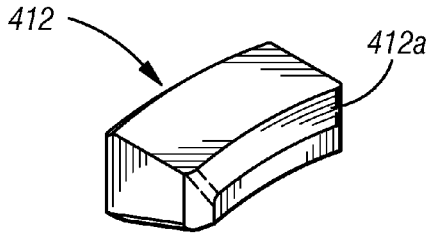

FIG. 9 is an enlarged cross-sectional view of the illustrative release piston 410 disclosed herein. The release piston 410 comprises a circumferential recess 410*a* and a tapered surface 410*b* that is adapted to engage a release segment 412. In one illustrative embodiment, the surface 410*b* is formed at an angle 410*c* of approximately 20 degrees. FIGS. 10A-10C depict various views of the illustrative release segments 412 disclosed herein. The release segment comprises tapered surfaces 412*a*, 412*b* and 412*c* have an outer position and an inner position. In one illustrative embodiment, the tapered surface 412*a* may be formed at an angle of approximately 25 degrees (relative to a vertical axis) and the tapered surface 412*b* may be formed at an angle of approximately 20 degrees (relative to a horizontal axis). The surfaces 412*c* may be formed at, for example, an angle of approximately 45 degrees.

A dynamic seal 30 is provided between the main filter housing 504 and the valve mandrel 506. In one illustrative embodiment, the seal 30 comprises an elastomeric seal with Teflon back-up rings. An elastomeric seal 30 may be employed in this location due to the relatively larger radial clearance between the sealed components as compared to other sealed components within the BHA. A wiper 528 that engages the valve mandrel 506 is attached to the main filter housing 504 so as to remove debris or sand from the valve mandrel 506 as it moves relative to the main filter housing 504.

Figure 5C:
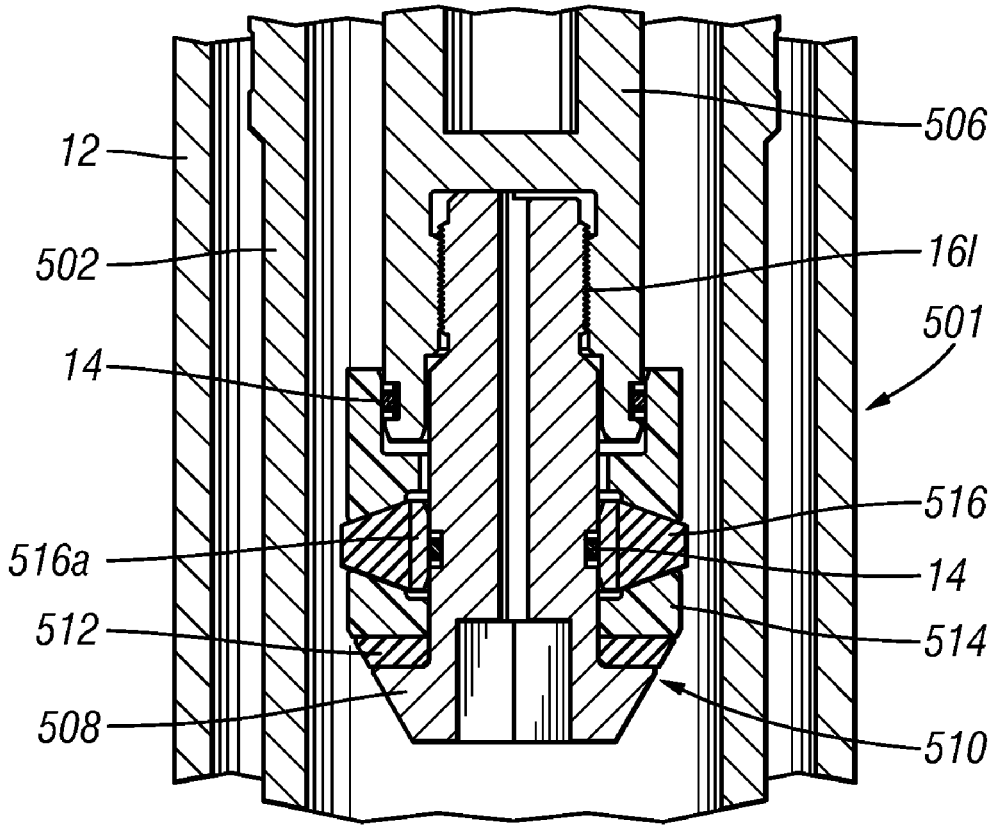
FIG. 5C depicts an embodiment of a valve that may be employed with the BHA described herein.

FIG. 5C is an enlarged view of the valve seal 510 and the valve cap screw 508. In one illustrative embodiment, the valve cap screw 508 is comprised of a steel material and is threadingly coupled to the valve mandrel 506 via the threaded connection 16*l*. In the illustrative example depicted herein, the valve seal 510 comprises three separate seal elements, i.e., a first valve backup ring 512, a second valve backup ring 514 and a valve seal 516. The seal elements 512, 514, 516 are mechanically retained in position by the valve cap screw 508. In one illustrative embodiment, each of the seal elements 512, 514 and 516 is made of a different material having different hardness values, such that the hardness of the ring 512 is greater than the hardness of the ring 514, which, in turn, is greater than the hardness of the seal 516, but each material may be soft enough to absorb sand particles to help prevent the seal assembly from becoming stuck within the seal bore and the need to apply a large force to open the valve. For example, in one particularly illustrative example, the first backup ring 512 may be comprised of a thermoplastic such as polyetheretherketone (PEEK), the second backup ring 514 may be comprised of fiber-filled Teflon, and the valve seal 516 may be comprised of an elastomer bonded to a steel ring 516*a*. Of course, other materials may also be employed depending upon the particular application.

Figure 1C:
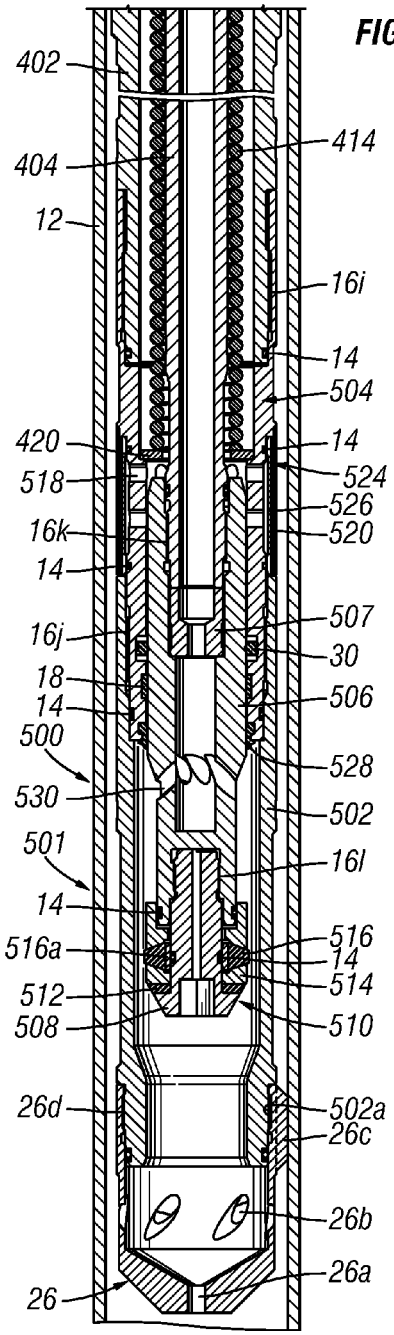

Additionally, in some applications, it may be sufficient to only have two different sealing materials, e.g., the first seal 512 may be made of PEEK, while the items 514, 516 may both be made of fiber-filled Teflon or an elastomer. In some applications, the use of three different seal elements for the valve seal 510 may not be used. For example, in some applications, the first backup ring 512 may be omitted while the second backup ring 514 and the valve seal 516 are made from materials having different hardness values. In general, the decrease in hardness of the seal elements that comprise the valve seal 510 can be beneficial in many applications. For example, in applications where significant amounts of sand pass between the valve 501 and the valve housing 502, the use of relatively harder valve seal material at the lower portion of the valve seal 510 may help prevent or reduce wear on the valve seal 510. In the instance there is sand or other particles present in the fluid as the valve is closing, the sand will potentially embed in the second backup ring 514, comprised of fiber filled Teflon, protecting the sealing element 516. Further, as discussed above, flow openings 530 (shown in FIG. 1C) in the valve mandrel 506 may be adapted to provide rotation to fluid flowing through the valve assembly 500. The rotational flow of the fluid may carry particles within the fluid outward against the housing 502 thereby potentially reducing wear that an abrasive fluid generally causes to softer valve materials. As the valve 501 is progressively closed from an open position to a closed position, a softer seal material may more readily seal against the inside diameter of the valve housing 502 when sand or debris is present, as compared to a seal comprised of a relatively harder material. A valve seal 516 with a relatively larger cross-section provides a better seal than a seal with a smaller cross section. Thus, in the depicted embodiment, the valve seal 516 has a relatively large cross-section.

Figure 2A:
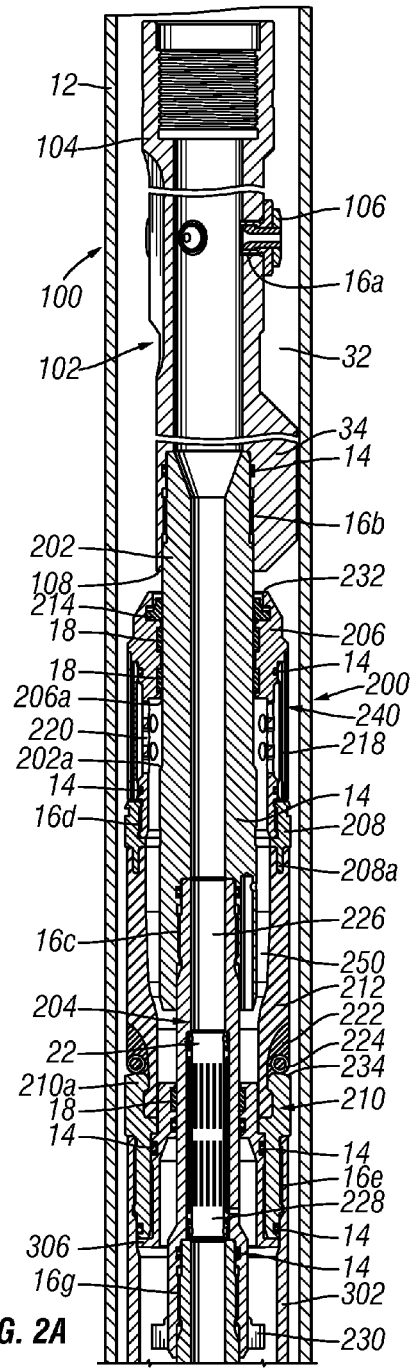
FIGS. 2A-2C depict the BHA of FIG. 1A-1C, wherein the anchor assembly of the BHA is set.
Figure 2B:
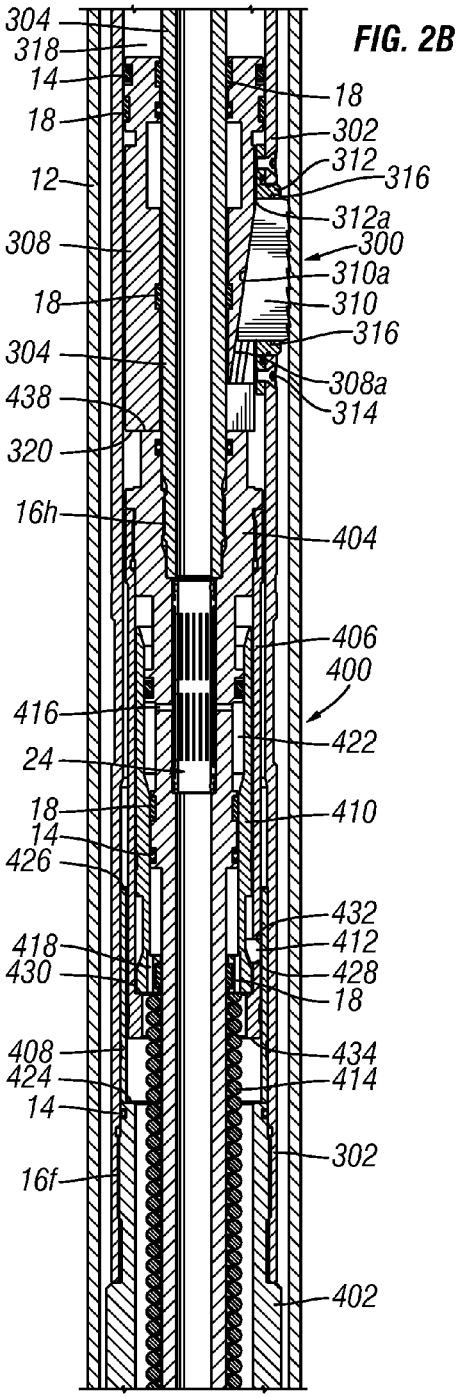
Figure 3A:
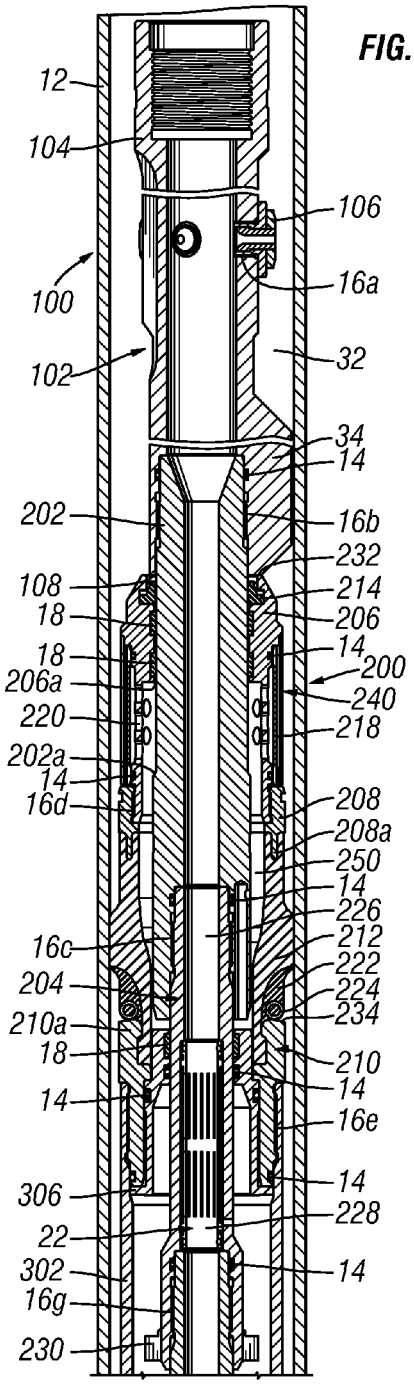
Figure 3B:
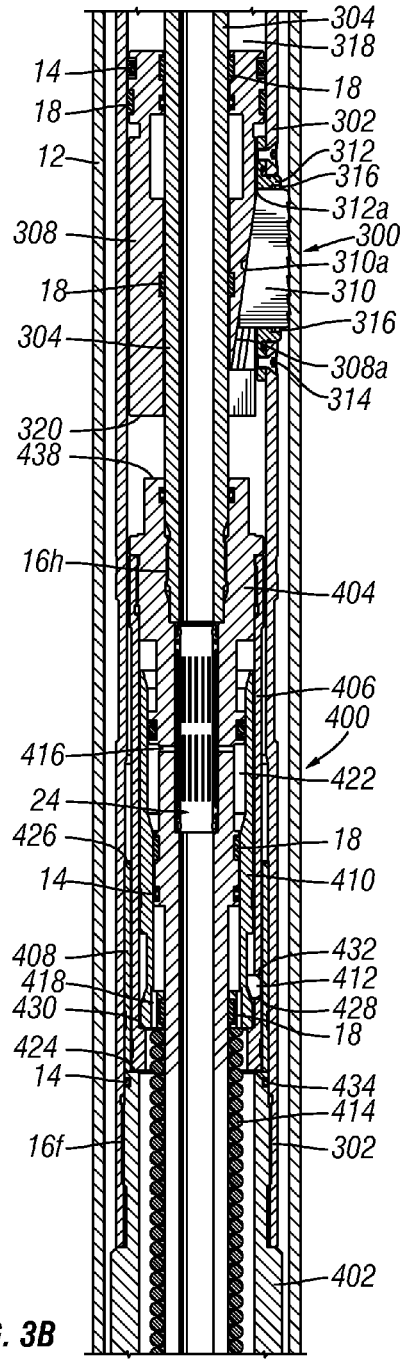

FIGS. 1A-1B depict the BHA and the packer assembly 200 in its initial "run-in" hole ("RIH") position. In this RIH position, the soft rubber element 212 is in its relaxed position, the release segments 412 are in their outer, unreleased positions, the anchor slips 310 are in their inner positions, and the valve 501 is in its open position. FIGS. 2A-2B depict the BHA wherein it is anchored in the casing 12 with the anchor slips 310 in their extended positions, the release segments 412 in their released positions, the soft rubber element 212 in its relaxed position, and the valve 501 in an open position. FIGS. 3A-3B depict the BHA and packer assembly 200 in the position where the soft rubber element 212 has been deformed by mechanical forces such that at least a portion of the outer surface of the rubber element 212 engages a portion of the inner surface of the casing 12, and the valve 501 is in its closed position. FIGS. 4A-4B depict the BHA and packer assembly 200 wherein the soft rubber element 212 is fully energized by a relative large differential pressure across the element 212 as described more fully below.

In use, the BHA ideally should be properly located vertically within the casing 12 at the desired zone to perforate and fracture. In some embodiments, vertically locating the BHA may be accomplished using one or more mechanical collar locators (not shown). In other cases, e.g., when perforating guns are employed, the vertical location of the BHA may be determined by magnetic sensing collar locators (not shown). The use of such means, and other similar means, for vertically positioning the BHA at the desired location within the casing 12 are well known to those skilled in the art, and thus they will not be described in any further detail. It should also be understood that by making reference to direction as "vertical" or the like does not imply that the BHA disclosed herein is limited in application to use in only vertical wells. To the contrary, the BHA described herein may be employed in virtually any type of well, e.g., horizontal wells, vertical wells, or deviated wells.

Among other things, a perforating and/or fracturing process may occur after the setting of the BHA within the casing 12. In FIGS. 1A-1B, the BHA is depicted in its circulating or RIH mode wherein a fluid may be pumped through the BHA and returned to the surface in a wellbore annulus 32 between the BHA and the casing 12. Normally, in coiled tubing operations, fluid is circulated through the BHA during most retrieval and insertion operations. For example, a clean fluid, such as water or a gelled water, may be circulated at a flow rate of approximately 250 liters/min as the BHA is run in to the desired location within the casing 12. This circulating flow rate may create a differential pressure in the BHA, e.g., across the anchor piston 308, on the order of approximately 100 psi. During this circulation process, the circulated fluid may exit the BHA by two paths, through the sand jet nozzles 106 and through the flow openings 530 and out the central flow opening 26*a* and radial side flow openings 26*b*. In some applications, the main orifice is sized such that approximately one-half of the circulating fluid entering the BHA escapes through the flow openings 530, while the other half of the circulating fluid exits through the sand jet nozzles 106. During the initial assembly of the BHA, the spring 414 is compressed such that it exerts a predetermined upward force ("uphole force") on the release piston 410, which could be approximately 300 lbs. of force. This upward force on the release piston 410 remains during the initial run-in of the BHA. The BHA remains in this RIH configuration as it is being positioned at the proper location within the well.

Figure 2C:
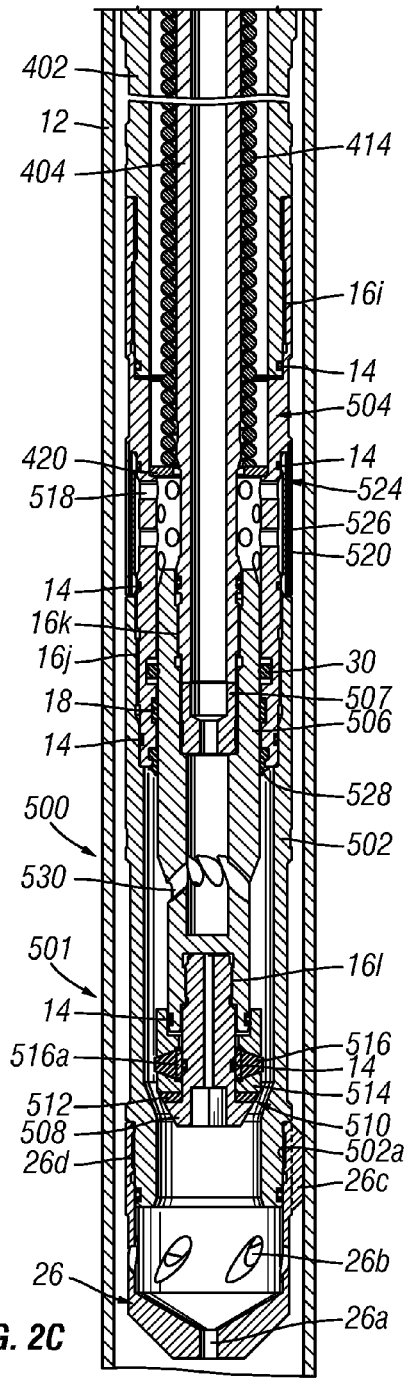

After the BHA is properly located, it can be anchored in the well. With reference to FIGS. 2A-2C, one illustrative process of setting the illustrative anchor assembly 300 disclosed herein will now be described. In general, the BHA comprises a mandrel assembly and a housing assembly that may be vertically moved relative to one another. The mandrel assembly is comprised of the sand jet housing 104, the upper packer mandrel 202, the lower packer mandrel 204, the anchor mandrel 304, the spring shaft 404 and the valve mandrel 506 components that are all hard coupled to one another via various threaded connections. The housing assembly is comprised of the packer filter housing 206, the packer lower crossover 210, the anchor housing 302, the spring housing 402, the main filter housing 504 and the valve housing 502. The release assembly 400 prevents relative movement between the mandrel assembly and the housing assembly while the release assembly is in a RIH configuration, and allows the relative movement while it is in a released configuration.

Once the BHA is at its desired location within the casing 12, the flow rate of circulation fluid through the BHA is gradually increased, e.g., the flow rate may be increased from approximately 250 liters/min to approximately 500 liters/min. The flow through the BHA exits the BHA through the sand jet nozzles 106 and central flow opening 26*a* and radial side flow openings 26*b* at the end of the main flow orifice. This increased flow of fluid causes the pressure inside the BHA to increase relative to the pressure outside of the BHA, i.e., the increased flow rate increases the differential pressure across the anchor piston 308 and the release piston 410. More specifically, the increased flow rate of circulating fluid, e.g., approximately 500 liters/min, causes the pressures in the anchor cavity 318 and the release cavity 422 to increase. As will be understood by those skilled in the art after a complete reading of the present application, the differential pressure across the release piston 410 is used to "release" the release assembly 400 and to initially actuate the pressure-actuated anchor slips 310 such that they engage the casing 12, as described in more detail below.

One advantage of the present disclosure is that the high flow rates described above remove debris from the casing prior to BHA setting. This advantage is beneficial because in a horizontal well, debris may be lodged within the casing, which may prevent the packer assembly 200 from forming a strong seal with the casing 12 internal surface. The fluid flowing at increased flow rates through the casing 12 may wash out any debris and thereby increase the chance that the BHA will set well in the casing 12. Further, debris within the casing may prevent the BHA from being properly centered within the casing. As discussed herein, the extrusion gap for the sealing element of the BHA may not be substantially uniform around its circumference if the BHA is eccentric within the casing, which may lead to failure of the seal. The anchor assembly 300 of the present disclosure provides active centralization of the BHA and also is actuated by high flow rates that may aid in the proper centralization of the sealing elements.

In general, the various components of the BHA, e.g., the anchor piston 308, the release piston 410, the anchor top bulkhead 306, the spring 414, etc., are sized and configured such that the release assembly 400 is not actuated until a desired differential pressure exists across the release piston 410. In the illustrative example of the BHA depicted herein, for an application involving perforating and fracturing a well with a 4" casing, the components of the BHA are sized and designed such that the release piston 410 does not release until the differential pressure across the release piston 410 is approximately 500 psi. Of course, in other applications, the selected value for the differential pressure that releases the release piston 410 may be different.

More specifically, when the pressure in the release cavity 422 is increased such that the differential pressure across the release piston 410 is at the desired value to permit movement, e.g., 500 psi, the release piston 410 is driven downward, thereby compressing the spring 414 until the release piston 410 engages the shoulder 430 on the release housing 406. Movement of the release piston 410 to this lower position aligns openings 432 in the release housing and the release segments 412 with a recess on the release piston 410. Additionally, when the pressure inside the anchor cavity 318 is increased, this high differential pressure, e.g., 500 psi, transmits an upward force on the anchor top bulkhead 306. In turn, the upward force on the anchor top bulkhead 306 is passed to the housing assembly (i.e., the packer filter housing 206, the packer lower crossover 210, the soft rubber element 212, the anchor housing 302, the spring housing 402, the main filter housing 504 and the valve housing 502). The upward force on the housing assembly is also transmitted to the release sleeve 408 since it abuts the end surface 424 of the spring housing 402. As this upward force is transmitted to the release sleeve 408, a conical end surface 426 of the release sleeve 408 engages corresponding conical end surfaces 428 of the release segments 412 to thereby urge the release segments 412 through the openings 432 in the release housing 406 and into the recess on the release piston 410. Thus, an increase in pressure inside the anchor cavity 318 causes the release segments 412 to move to a released configuration, or in other words, to move into the release piston 410 recess.

While the release segments 412 are in the released configuration, the release sleeve 408 is permitted to move upward relative to the mandrel assembly, and thus the anchor top bulkhead 306 and the housing assembly are likewise permitted to move upward relative to the mandrel assembly. Upward movement of the housing assembly also causes the anchor slips 310 to move relative to the anchor piston 308, thereby causing the anchor slips 310 to move radially outward and engage the inside of the casing 12 by virtue of the interaction between the inclined surfaces 308*a* and 310*a*. At this point the anchor assembly 300 is set, i.e., the anchor slips 310 are biting into the casing 12, and the setting has been accomplished by use of hydraulic pressure. In the illustrative example depicted herein, a 500 psi differential pressure results in approximately 2700 pounds of radial force being transmitted to each of the anchor slips 310 while the valve 501 is open. It may not be required to maintain the illustrative 500 psi differential pressure after the anchor slips 310 are initially set. The operator may confirm that the anchor assembly 300 is set by allowing some of the weight of the coiled tubing string to be placed on the anchor assembly 300, i.e., by reducing the tension on the coiled tubing string at the surface, or by otherwise adding "weight" to the BHA. The operator may also confirm that the anchor assembly 300 is set by observing an increase in the pressure within the BHA because the valve 501 may only be closed if the anchor assembly 300 is set, as discussed below. Note that, in the position depicted in FIGS. 2A-2C, the soft rubber element 212 has not yet engaged the casing 12, while the anchor assembly 300 has been set using hydraulic pressure.

One novel feature of the disclosure is the BHA's ability to center the soft rubber element 212, the hard rubber element 222, and the embedded spring 224 within the casing 12, and to further maintain these elements in a concentric relationship with the casing 12 so that there is substantially equal extrusion gap around the circumference of these elements. If the spring 224 is allowed to have any substantial amount of eccentricity, the seal 212, 222 may fail. For example, an eccentricity of as little as 1/16th of an inch may cause the seal to leak. The concentric positioning of the spring 224 is important as the pressure and temperatures increases. The fracturing pressure employed during an ACT-Frac Process are generally not well known prior to beginning the procedure and the elevated fracturing pressures may lead to seal failure if the sealing elements 212, 222, and spring 224 are not properly centered within the casing. If the BHA is not properly centered within the casing, the embedded spring 224 may not be adequately supported leading to seal failure as discussed below in regards to FIGS. 11A-11B.

In the present disclosure, the anchor slips 310, by applying forces to the inner surface of the casing, provide centering forces to the BHA, centering the BHA within the casing and allowing the sealing elements 212, 222, and spring 224 to have little or no eccentricity within the casing. One advantage of this disclosure is that the anchor slips 310 are able to provide the centering forces no matter the orientation of the casing 12, i.e., whether the well bore is vertical, horizontal, or deviated. The centralizing feature is active because the anchor slips 310 actively apply the most force to an inner surface of the casing 12 that is closest to the BHA, and push the BHA towards an axial center of the casing. This active centralization feature of the anchor slips 310 functions for various inner diameters of a casing 12, so that the BHA may be used and properly centered various weights of the same diameter casing 12.

As depicted in FIGS. 1A-4A, the BHA includes rigid centralizers 34 that help to further center the BHA within the casing 12 in conjunction with the active centralization function of the anchor slips 310. The rigid centralizers 34, which do not extend or retract as the anchor slips 310, help to maintain the BHA centered within the wellbore as it is ran to the desired location. In the depicted embodiment, the rigid centralizers 34 are generally located on a proximate or uphole portion of the BHA from the packer assembly 200, whereas the anchor slips 310 are located distally or downhole from the packer assembly. The positioning of the packer assembly 200 between the rigid centralizers 34 and the anchor slips 310 that provide active centralization help to ensure that the sealing elements 212, 222, and spring 224 are concentrically positioned within the casing 12.

Next, as shown in FIGS. 3A-3C, various actions are taken to mechanically engage the soft rubber element 212 with the casing 12 and to close the valve 501. After it is confirmed that the anchor assembly 300 is set, the operator may then effectively add weight to the mandrel assembly by running additional coiled tubing 20 into the well. Running this additional coiled tubing 20 causes the valve 501 to close due to added downward force on the mandrel assembly, and causes the soft rubber element 212 to initially mechanically engage or set against the inside surface of the casing 12. Since the valve seal 510 is hard-coupled to the mandrel assembly, downward movement of the mandrel assembly causes the valve seal 510 to move downward within the valve housing 502. FIG. 2C depicts the valve seal 510 in an intermediate position. As increased downward force is applied to the mandrel assembly, the valve seal 510 continues to move downward until reaching a closed position, as depicted in FIG. 3C, wherein the valve seal 510 has mechanically engaged with an internal surface of the valve housing 502. As the mandrel assembly is forced downward in relation to the housing assembly, by the added coiled tubing 20 weight, the end surface 108 of the sand jet housing 104 engages an end surface 232 of the packer filter housing 206. Further downward movement of the sand jet housing 104 causes the soft rubber element 212 to mechanically deform radially outward and engage the casing 12. The end result of this mechanical deformation process is that the soft rubber seal 212 forms a relatively light seal with the casing 12, e.g., a seal able to withstand approximately 1000 psi. As mentioned above, the valve 501 cannot close while the anchor assembly 300 has not been set. The valve 501 is closed by adding coiled tubing 20 weight onto the BHA. However, if the anchor assembly 300 has not been set, adding coiled tubing 20 down a casing 12 will only act to move the entire BHA downhole, rather than moving only the mandrel assembly. If the mandrel assembly cannot move downhole relative to the housing assembly, the valve 501 cannot close and the soft rubber seal 212 cannot be deformed outward.

With the valve 501 closed, and the flow rate still at approximately 500 liters/min, the pressure within the anchor cavity 318 and release cavity 422 increases such that there is a differential pressure across the anchor piston 308 and the release piston 410 of approximately 2000 psi. This increased differential pressure across the anchor piston 308 generates a radial force of approximately 11,000 pounds on each of the anchor slips 310 causing them to further bite into or engage the casing 12. When the release piston 410 is in this fully extended position, the spring 414 exerts an uphole force on the release piston 410 of approximately 320 pounds. The engagement between the release housing 406 and the spring housing 402 also acts to limit the amount of mechanical compressive force that can be applied to the soft rubber element 212 by virtue of downward movement of the mandrel assembly. The end surface 424 of the spring housing 402 provides a mechanical stop for the end surface 434 of the release housing 406 when the BHA is in the set configuration.

In the position shown in FIGS. 3A-3B, perforating operations may now be performed to perforate the well using the perforating assembly 100. For example, a sand slurry may be pumped through the coiled tubing 20 to the BHA at flow rates of approximately 400-500 liters/min for a duration of approximately 10 minutes. They slurry will exit the sand jet nozzles 106, thereby forming openings (not shown) through the casing 12 and into the formation. Thereafter, various clean up operations may be performed to flush out at least some of the residual material left over from the perforating operation.

As shown in FIGS. 4A-4B, the next process operation involves fracturing. In general, fracturing involves the high pressure injection of a proppant-containing fluid down the wellbore annulus 32 into the formation through the openings in the casing into the fractures formed in the formation during the perforation process. The fracturing pressure within the wellbore annulus 32 is typically very high and it is typically generated by high pressure pumps located at the surface. For example, depending upon the formation pressure, fracturing pressure may be 5,000-10,000 psi greater than the formation pressure. At the same time fracturing pressure is being increased in the wellbore annulus 32, the flow rate of circulating fluid through the coiled tubing 20 and the BHA may be reduced to approximately 100 liters/min. This reduced flow rate results in the differential pressure within the tool being reduced from approximately 500 psi to approximately 100 psi. Even with this reduced internal pressure within the BHA, there is still sufficient force applied to the anchor slips 310 to anchor the BHA in the casing 12.

The fracturing pressure is also present in the cavity 250 behind the soft rubber element 212. The cavity 250 is exposed to this higher pressure in the wellbore annulus 32 by virtue of the flow path provided through the packer filter 218 and the holes 220 in the packer filter housing 210. The high fracturing pressure in the cavity 250 is much greater than the pressure existing below the soft rubber element 212. Thus, the relatively high differential pressure across the soft rubber element 212 forcefully drives the outer surface of the soft rubber element 212 into engagement with the inner surface of the casing 12. In some applications, the differential pressure across the soft rubber element 212 may be 2000-7000 psi, depending upon the particular application. The pressure-energized seal created using the soft rubber element 212 provides a substantial seal against pressure that may be exerted above the soft rubber seal 212 during perforating and/or fracturing operations. As shown in FIGS. 4A-4B, as the pressure within the cavity 250 increases, the soft rubber element 212 further deforms and the hard rubber element 222 and spring 224 deform and expand outward to act as anti-extrusion elements and provide support to the soft rubber element 212 as it resists and deforms due to the relatively high differential pressure across the soft rubber element 212. The hard rubber element 222 and spring 224 prevent the extrusion of the soft rubber element 212 past the hard rubber element due to relatively high different pressure especially at elevated temperatures. After establishing this pressure-energized seal, fracturing operations may now be performed above the packer assembly 200 as the packer assembly 200 now hydraulically isolates the wellbore below.

After fracturing operations are performed, various post-fracturing activities may be conducted if desired. For example, measurements may be taken as to various characteristics of the well, e.g., porosity, etc. In other cases, such post-fracturing operations may not be performed, and the steps associated with unsetting the BHA may be performed.

The unsetting of the BHA and the seal provided by the soft rubber element 212 may be accomplished by pulling up on the coiled tubing 20. Pulling up on the coiled tubing 20 lifts the valve 501 to its open position, thereby permitting the pressure differential across the soft rubber element 212 to equalize. The upward pull on the coiled tubing 20 causes the surface 438 of the spring shaft 404 to engage the bottom surface 320 of the anchor piston 308 until the pressure differential is adequately equalized. The engagement of the mandrel assembly with the anchor piston 308 provides resistance to further movement until the pressure differential has been sufficiently equalized providing feedback to the operator that the valve has been opened and the mandrel assembly has been pulled against the anchor piston 308.

There are numerous factors that determine how long it will take the pressure differential to equalize enough to permit the packer elements 212, 222, and 224 to unset. The types of fluids used, including energized fluids, the size of the fracture and the total volume of fluid pumped, the permeability and porosity of the reservoir and each zone, the size of the main orifice and the sand jet perforating nozzle size and quantity all influence the time for the pressure to equalize. Once the pressure differential across the sealing elements 212, 222 and the embedded spring 224 is low enough, continued pulling on the coiled tubing 20 moves the anchor piston 308 uphole causing the anchor slips 310 to disengage from the casing 12 by virtue of the interaction between the elongated projections 308*b* (on the anchor piston 308) and the elongated slots 310*b* (in the anchor slips 310). This movement of the mandrel assembly also causes the soft rubber element 212 to return to its initial relaxed position (shown in FIG. 1). As discussed below, the anchor assembly 300 and packer 200 remain set until the pressure differential across the packer 200 is sufficiently reduced, for example to 1000 psi or less. If it were possible to unset the anchor assembly 300 while a high pressure differential remained across the packer 200, the force on the packer 200 may push the BHA downhole breaking the coiled tubing 20. This event is undesirable causing added expense to retrieve the coiled tubing and the BHA from the well. In addition, this event has the potential for the operator to lose pressure control of the well, potentially being harmful to personnel and/or the environment. Because this embodiment of the anchor assembly 300 is pressure set, it is not possible for the anchor assembly 300 to become unset until the pressure differential across the packer 200 is sufficiently reduced.

Near the end of the movement of the mandrel assembly, the mandrel assembly creates a tension force in the soft rubber element 212 by virtue of it being fixedly coupled, i.e., bonded, to the packer top ring 208 and the packer lower crossover 210. More specifically, as the coiled tubing 20 is retrieved, a surface 202*a* on the upper packer mandrel 202 engages a surface 206*a* on the packer filter housing 206. Once the surfaces 202*a* and 206*a* are engaged, further pulling of the coiled tubing 20 results in a tension force being applied to the soft rubber element 212 which will further encourage the soft rubber element 212 to tend to return to its pre-deformed configuration. Engagement between the flange 230 on the lower packer mandrel 204 and the anchor top bulkhead 306 limits the amount of tension that may be applied to the soft rubber element 212 during the coiled tubing pulling process. Application of this tension force to the soft rubber element 212 during the retrieval process tends to make the soft rubber element 212 return to its original shape. The hard rubber piece 222, and especially its embedded spring 224 provide a returning force to more quickly and completely return the soft rubber element 212 to its original shape. The upward pulling force on the coiled tubing also causes the mandrel assembly, which includes the release piston 410 and release housing 406 to move up relative to the housing assembly, which includes the release sleeve 408. The release piston 410 moves upward relative to the release sleeve 408 until the release segments 413 are aligned with the release sleeve 408 conical end 426. Continued upward movement of the release piston 410 causes the release piston tapered surface 410*b* to apply a radially outward force to the corresponding release segment tapered surfaces 412*b*, urging the release segments 412 back to a RIH position.

In general, the anchor assembly 300 remains set until the pressure differential across the packer 200 has sufficiently decreased. For example, the embedded spring 224 in the hard rubber element 222 will typically retract the soft rubber element 212 once the pressure differential decreases to 1000 psi or less. The pressure differential across the packer 200 may be equalized by pulling up on the coiled tubing 20 to open the valve 501 to permit flow through the BHA, which will equalize the pressure above and below the packer 200. Once the packer 200 is unset, the pressure differential will rapidly equalize because of the greater flow area with respect to the flow path through the BHA while the packer 200 is set. In this manner, the operator does not have to overcome a pressure differential to unset the anchor 300, but rather can merely pull up with enough force to move the weight of the BHA, accounting for the friction between the moving components of the BHA. If the circulating fluid pump were to fail and pressure were lost, the BHA will remain anchored to the casing 12 as long as the coiled tubing 20, and thus the anchor piston, is not pulled up. One beneficial novel feature of the disclosure is that the anchor assembly 300 can be set by increasing pressure of a circulating fluid in the wellbore but unset by an up hole mechanical force.

Once the BHA has been disengaged, the BHA may now be re-positioned within the well so that additional perforating and/or fracturing operations may be performed. The BHA disclosed provides for an efficient procedure for rapidly setting and unsetting of the anchor and packer assemblies.

Figure 11A:
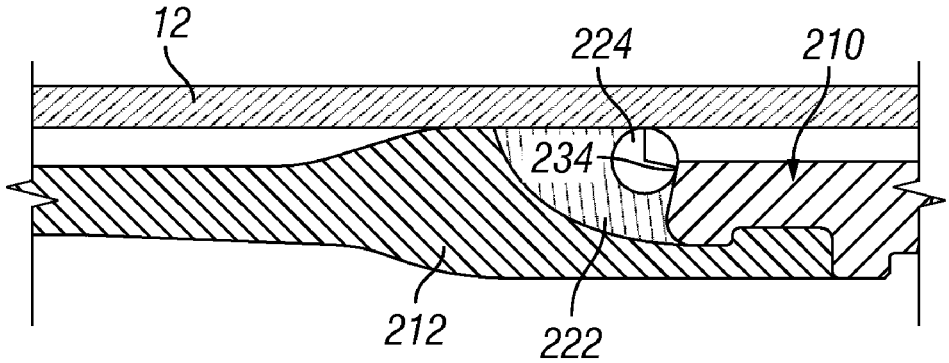
FIGS. 11A-11B depict a sealing element engaged with a casing.
Figure 11B:
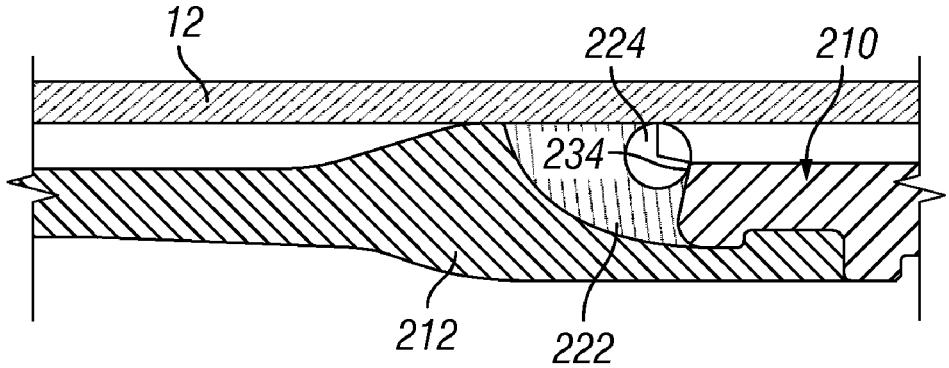

As indicated previously, performing operations such as perforating or fracturing through coiled tubing can be very problematic if the tools involved, e.g., packers, become stuck in the wellbore. Another factor in packers employed in coiled tubing applications is that they be able to establish a seal that is sufficient to withstand substantial pressures seen during some downhole operations, e.g., fracturing. The packing element disclosed may be used to repeatedly isolate wellbore locations due to its rapid return to substantially its original size and shape, which helps to prevent the BHA from becoming stuck within the casing. The rapid unsetting of the packing element to its original size and shape over repeated setting and unsetting procedures is beneficial as a partially unset packing element could potentially cause the BHA to become stuck in the wellbore. For example, a partially unset packing element may become caught within the casing or may lead to the buildup of a sand bridge potentially causing the BHA to become stuck. The anchor assembly disclosed secures the BHA within the casing and provides active centralization of the disclosed packer assembly to prevent seal failure at elevated pressures and temperatures FIGS. 11A-11B depict the soft rubber element 212 and hard rubber element 222 engaging with a casing 12. These figures illustrate the importance of the active centralization feature of the present disclosure. While fluid pressures within the casing 12 above the sealing elements 212, 222, and spring 224 are increased, the fluid exerts a downward force on the sealing elements 212, 222, and spring 224. A shoulder 234 of a packer lower crossover 210 prevents the spring 224 from extruding downhole. Ideally, the spring 224 should not radially extend beyond the shoulder 234 more than a distance equal to a radius of the spring's 224 individual coils to ensure that the spring 224 is adequately supported by the shoulder 234. Thus, the annular space between the shoulder 234 and the casing 12 should be less than the radius of the spring's 224 coils so that the casing 12 will prevent the spring 224 from extending beyond its ideal extension limit described herein. In FIG. 11A, the BHA, sealing elements 212, 222, and spring 224 are centered within the casing 12, which means that the radial distance between the sealing elements 212, 222, and spring 224 and the casing 12 is the same at any point around the circumference of the sealing elements 212, 222, and spring 224. Because the BHA and sealing elements 212, 222, and spring 224 are centered within the casing 12, the shoulder 234 adequately supports the spring 224 and prevents the spring 224, the hard rubber element 222, and the soft rubber element 212 from extruding downhole.

In FIG. 11B, the sealing elements 212, 222, and spring 224 are eccentric, which means that at least some points of the sealing elements 212, 222, and spring 224 are farther away from the casing 12 than other points. Such eccentricity may be due to the sealing elements 212, 222, and spring 224 not being centered within the casing 12. Any of these potential cases may cause a portion of the casing 12 internal surface to be a greater distance away from the shoulder 234 than an ideal distance, which may allow the spring 224 to extend too far beyond the shoulder 234. As shown in FIG. 11B, if the spring 224 is thus extended, the shoulder 234 only provides limited support to the spring 224, which may cause the spring's 224 individual coils to cant over, leading to seal failure. Even a small amount of sealing element 212, 222, or spring 224 eccentricity within the casing 12 may lead to seal failure especially at elevated pressures. As the pressure increases, the load on the embedded spring increases. As discussed above, both the anchor slips 310 and the rigid centralizers 34 keep the BHA centered in the casing 12 and thus maintain the spring 224 in a concentric relationship with the casing 12. Because these elements 310, 34 of the BHA keep it centered within the casing 12, the possibility of eccentricity of the sealing elements 212, 222, and spring 224 is minimized, which likewise minimizes the possibility of seal failure. This reduction in the probability of seal failure is especially true in horizontal or deviated wells, where the BHA weight on the sealing elements 212, 222, and spring 224 will naturally cause them to become eccentric within the casing 12 if the BHA has no centralization function.

The present disclosure is unique in that it provides BHA for coiled tubing having an anchor assembly 300 adapted to centralize a packer assembly 200, wherein the soft rubber element 212 of the packer assembly 200 is initially compressed by mechanical force to form an initial seal with the casing and thereafter subjected to a relatively large differential pressure across the element 212 so as to form a pressure-energized seal with the casing 12. The packer assembly 200 is also unique in that there is a relatively large radial clearance between the inside surface of the casing 12 and the outer surface of the element 212 and the other components of the packer assembly 200, e.g., the packer filter housing 206, the packer top ring 208 and the packer lower crossover 210. The large radial clearance is important as it prevents that BHA from becoming stuck in the well. The packer assembly 200 has a radial clearance, stated another way, an expansion ratio (ER) that may be defined as:

$$\text{Expansion Ratio} = \frac{\text{Expanded } OD \text{ of Element 212}}{\text{Relaxed } OD \text{ of Element 212}}$$

The packer assembly 200 is also unique in that the soft rubber element 212 can quickly revert to its relaxed state because of the tension that may be applied to it by pulling on the coiled tubing string 20, and also the returning force applied to it by the hard rubber element 222 and spring 224. This property of the disclosure allows for a shorter time cycle between subsequent perforating and fracturing operations when compared to prior art packer assemblies because prior art sealing assemblies use seals that take much longer to return to their original state.

The BHA disclosed herein may be employed in 4" casing of varying weights. For example, the packer assembly 200 described herein may be employed in 9.5-15.1 lb/ft 4" casing having an inside diameter of 4.090" and 3.826", respectively. The active centralization of the anchor assembly will properly center the packer assembly whether the casing 12 inner diameter is 4.090" or 3.826". The ability of the same anchor assembly to properly center the packer assembly for each weight of the same size of casing potentially reduces the inventory a service company will need to have available. However, different size packing elements 212, 222 may have to be used in the different weight casings to ensure the extrusion gap is not too large for the expected pressures and temperatures. In one illustrative example, the soft rubber element 212 may have an outside diameter of approximately 3.5 inches, while the other components, such as the packer filter housing 206, the packer top ring 208 and the packer lower crossover 210, may have an outer diameter of approximately 3.6 inches. Thus, in one illustrative example, wherein the packer assembly 200 is employed with 4.090" ID casing, the radial clearance between the outside surface of the soft rubber element 212 and the inner surface of the casing 12 may be approximately 0.25 inches. This radial clearance for the seal element of this compression set packer is very large relative to prior art compression set packers which normally had a radial clearance of approximately 0.05-0.12 inches. The very small clearance required for prior art compression set packers made them less than desirable for coiled tubing applications due to fear of getting the BHA stuck in the well. In other applications, where the BHA may be employed in heavier weight 4" casing, e.g., 15.1 lb/ft casing with an inside diameter of 3.826 inches, the outside diameter of the element 212 may be approximately 3.3 inches while the outside diameter of the other components of the packer assembly 200, e.g., the packer lower crossover 210, may be approximately 3.4 inches.

The Expansion Ratio of the illustrative soft rubber element 212 disclosed herein may range from 1.160 (3.826/3.3)–1.169 (4.09/3.5). This is in contrast to prior art compression set packers wherein the expansion ratio, as defined herein, was approximately 1.049 (4.09/3.9). By providing a packer assembly 200 with a relatively large radial clearance, the packer assembly 200 may be more readily employed in various tubing applications, such as perforating and fracturing operations.

The particular embodiments disclosed above are illustrative only, as the disclosure may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the disclosure. Accordingly, the protection sought herein is as set forth in the claims below.

What is claimed:

1. A bottom hole assembly (BHA) adapted to be connected to coiled tubing and positioned within a casing having an internal diameter, the BHA comprising:

a perforating assembly, the perforating assembly including a fluid path in communication with the coiled tubing;

a packer assembly, the packer assembly comprising:

an upper packer mandrel connected to the perforating assembly, the upper packer mandrel having a fluid path in communication with the fluid path of the perforating assembly;

a packer filter housing slidably connected to the upper packer mandrel, the packer filter housing including flow ports in communication with an annulus between the coiled tubing and an internal surface of the casing;

a lower packer mandrel connected to the upper packer mandrel, the lower packer mandrel having a fluid path in communication with the fluid path of the upper packer mandrel;

a lower packer crossover member;

a first annular sealing element, the first annular sealing element being connected to the packer filter housing and to the lower packer crossover member, wherein a downward movement of the packer filter housing with respect to the lower packer crossover member engages the first annular sealing element with the internal surface of the casing to create an initial seal;

a second annular sealing element connected to the first annular sealing element and the lower packer crossover member;

a spring embedded within the second annular sealing element, wherein annular pressure may communicate through the packer filter housing flow ports to engage the first and second sealing elements with the internal surface of the casing to pressure-energize the initial seal;

an anchor assembly that may be repeatedly moved between a set position and an unset position within the casing, the anchor assembly comprising:

an anchor housing, the anchor housing being connected to the lower packer crossover member;

an anchor mandrel being axially slidable within the anchor housing;

a plurality of anchor slips extendable from the anchor housing;

a release assembly, the release assembly adapted to selectively retain the anchor in the unset position, wherein an increase in pressure within the BHA to a predetermined amount releases the anchor to move to the set position;

a valve assembly connected to the release assembly.

2. The BHA of claim 1, wherein the second annular sealing element has a harder durometer measurement than the first annular sealing element.

3. The BHA of claim 2, wherein the second annular sealing element and the embedded spring prevent extrusion of the first annular sealing element below the second annular sealing element.

4. The BHA of claim 1, wherein each anchor slip has an outwardly-facing casing-engaging surface and an inclined surface, and wherein the anchor assembly further comprises:

a plurality of anchor bushings, the anchor bushings defining openings in the anchor housing and being radially distributed around the anchor housing wherein each anchor slip is located inside an anchor bushing;

an anchor piston connected to the anchor mandrel and comprising a plurality of inclined surfaces corresponding to and abutting against the plurality of anchor slip inclined surfaces.

5. The BHA of claim 4, wherein the anchor assembly is adapted to actively centralize the BHA within the casing.

6. The BHA of claim 1, wherein the release assembly comprises:

a spring housing connected to the anchor housing;

a spring shaft connected to the anchor mandrel;

a release housing connected to the spring shaft and having at least one release segment opening;

at least one release segment having a plurality of tapered surfaces, adapted to prevent vertical movement of the spring housing relative to the spring shaft while the plurality of release segments are located within the release segment openings;

a release sleeve connected to the spring housing, having a tapered end corresponding to the plurality of release segment tapered surfaces, the release sleeve tapered end being adapted to urge the plurality of release segments out of the release segment openings when an upward force is applied to the release sleeve;

a release piston radially surrounding the spring shaft, the release piston being slidable within the release housing and having at least one release segment recess;

a spring ring adjacent to the spring housing; and a spring coiled around the spring shaft disposed between the release piston and the spring ring.

7. The BHA of claim 1, wherein the valve assembly comprises a valve seal within a valve bore, the valve seal being adapted to form a seal with the valve bore in response to a downward force applied through the coiled tubing.

8. The BHA of claim 1, wherein the valve assembly further comprises:

a valve housing;

a main filter housing connected to the valve housing;

a valve mandrel connected to a release assembly spring shaft;

a main orifice positioned in a cavity formed in the valve mandrel;

a valve cap screw connected to the valve mandrel;

a valve seal assembly connected to the valve mandrel and the valve cap screw.

9. The BHA of claim 8, wherein the valve seal assembly comprises at least one valve backup ring and a valve seal.

10. A bottom hole assembly (BHA) adapted to be connected to coiled tubing and positioned within a casing having an internal diameter, the BHA comprising:

a packer assembly comprising at least a first annular sealing element, a second annular sealing element, and a spring embedded within the second annular sealing element, wherein the second annular sealing element has a harder durometer measurement than the first annular sealing element;

an anchor assembly, wherein the anchor assembly is adapted to be set within the casing by fluid pressure and mechanically unset from the casing;

a valve assembly and a release assembly adapted to selectively retain the unset anchor assembly and release the anchor assembly upon an increase in fluid pressure to a predetermined amount, the valve assembly comprising a valve housing having a first portion with a first inner diameter and a second portion having a seal bore, wherein the seal bore has an inner diameter smaller than the first inner diameter; and a valve seal assembly comprising a valve seal and at least one valve backup ring that is slidable within the valve housing, wherein the valve seal is adapted to seal against an inner surface of the seal bore.

11. The BHA of claim 10, wherein the first annular sealing element has an expansion ratio greater than 1.15.

12. The BHA of claim 10, wherein the valve seal assembly further comprises:

a valve cap screw; and a first and second valve backup ring, wherein the valve cap screw is positioned distally from the valve seal, the valve seal is positioned distally from the second backup ring, and the second backup ring is positioned distally from the first backup ring.

13. The BHA of claim 12, wherein the first backup ring has a harder durometer measurement than the second backup ring and the second backup ring has a harder durometer measurement than the valve seal.

14. A bottom hole assembly (BHA) adapted to be connected to coiled tubing and positioned within a casing having an internal diameter, the BHA comprising:

an anchor housing;

a plurality of anchor bushings in the anchor housing;

a plurality of anchor slips, each anchor slip being located within an anchor bushing and having a radially inward-facing inclined surface;

an anchor piston located inside the anchor housing, the anchor piston having at least one radially outward-facing inclined surface, wherein each anchor piston radially outward-facing inclined surface abuts a corresponding radially inward-facing inclined surface of the plurality of anchor slips, and wherein the anchor slips are adapted to extend and engage the casing in response to a pressure increase in a circulating fluid, and to retract in response to a mechanical force applied by the coiled tubing; and a fluid path and a packer assembly comprising an upper packer mandrel connected to the BHA, the upper packer mandrel having a fluid path in communication with the fluid path of the BHA;

a lower packer mandrel connected to the upper packer mandrel, the lower packer mandrel having a fluid path in communication with the fluid path of the upper packer mandrel a packer filter housing slidably connected to the upper packer mandrel, the packer filter housing including flow ports in communication with an annulus between the coiled tubing and an internal surface of the casing;

a lower packer crossover member;

a first annular sealing element, the first annular sealing element being connected to the packer filter housing and to the lower packer crossover member, wherein a downward movement of the packer filter housing with respect to the lower packer crossover member engages the first annular sealing element with the internal surface of the casing to create an initial seal; and a second annular sealing element connected to the first annular sealing element and the lower packer crossover member, the second annular sealing element having an embedded annular spring.

15. The BHA of claim 14, wherein the anchor housing is adapted to move axially relative to the anchor piston in response to an increased fluid pressure within the casing.

16. The BHA of claim 15, wherein the plurality of anchor slips are adapted to extend from the anchor bushings in a radially outward direction in response to an axial movement of the anchor housing relative to the anchor piston.

17. The BHA of claim 16, wherein the anchor slips are adapted to centralize the BHA within the casing when the anchor slips are extended from the anchor bushings.

18. The BHA of claim 14, wherein the upper packer mandrel is adapted to move downhole, toward the lower packer mandrel, in response to an applied downward mechanical force, thereby causing the first annular sealing element to deform in a radially outward direction, engaging a casing internal surface and establishing an initial seal with the casing.

19. A method of isolating a portion of a wellbore, the method comprising:

positioning a bottom hole assembly (BHA) at a depth within a casing;

setting an anchoring mechanism of the BHA by increasing a pressure differential within the BHA, wherein the anchoring mechanism secures the BHA to a casing; and creating a seal against an interior surface of the casing by applying an axial mechanical force to the BHA by applying the mechanical force in a downhole direction onto the BHA to deform a first annular sealing element in an outward direction thereby engaging the interior surface of the casing, forming an initial seal with the casing, and further increasing the pressure differential through a packer housing across the seal to pressure-energize the first annular sealing element, thereby pressure-energizing the initial seal.

20. The method of claim 19, wherein increasing the pressure differential within the BHA is accomplished by increasing a fluid flow rate within a coiled tubing.

21. The method of claim 20, wherein increasing the fluid flow rate removes debris from between a BHA sealing element and an inner surface of the casing.

22. The method of claim 19, further comprising:

performing a perforating operation on the interior surface of the casing after creating the seal against the interior surface of the casing by applying an axial mechanical force to the BHA.

23. The method of claim 19, wherein activating the anchoring mechanism comprises:

increasing the pressure differential within the BHA to drive an anchor housing in an axial direction; and extending a plurality of anchor slips in a radially outward direction to engage with the interior surface of the casing in response to the vertical movement of the anchor housing.

24. The method of claim 23, wherein extending the plurality of anchor slips in a radially outward direction to engage with the interior surface of the casing centers the BHA within the casing.

25. The method of claim 23 further comprising decreasing the pressure differential within the BHA, wherein the plurality of anchor slips remain extended and engaged with the interior surface of the casing.

26. The method of claim 19, wherein applying the mechanical force in a downhole direction closes a valve within the BHA.

27. The method of claim 26 further comprising applying a mechanical force in an uphole direction to open the valve equalizing the pressure differential within the BHA.

28. The method of claim 27 further comprising applying a second mechanical force in an uphole direction to unset the anchor mechanism after the pressure differential has equalized below a predetermine amount.

29. The method of claim 19, wherein extending the plurality of anchor slips is triggered by increasing the pressure within the BHA.

30. The method of claim 19, further comprising:

disengaging the anchoring mechanism; and releasing the seal.

31. The method of claim 30, wherein disengaging the anchoring mechanism comprises decreasing the pressure within the BHA.

32. The method of claim 30, wherein disengaging the anchoring mechanism comprises providing a mechanical force in an uphole direction to the BHA.

33. The method of claim 30, wherein releasing the seal comprises providing a mechanical force in an uphole direction to the BHA.

34. The method of claim 30, wherein releasing the seal comprises decreasing the pressure within the BHA.

35. A method of setting a bottom hole assembly (BHA) within a casing, the method comprising:

increasing a pressure differential within a BHA to drive an anchor housing in an axial direction;

extending a plurality of anchor slips in a radially outward direction to engage with an interior surface of the casing, thereby centering the BHA within the casing and anchoring the BHA to the casing;

applying a mechanical force in a downhole direction onto the BHA to close a valve in the BHA;

deforming a first annular sealing element in an outward direction;

engaging the first annular sealing element with the interior surface of the casing, thereby forming an initial seal with the interior surface of the casing;

increasing the pressure differential across the first annular sealing element;

pressure-energizing the first annular sealing element, thereby pressure-energizing the initial seal.

36. The method of claim 35 further comprising reducing the pressure differential within the BHA, wherein the plurality of anchor slips remain extended and engaged with the interior surface of the casing.

37. The method of claim 36 further comprising applying a mechanical force in an uphole direction to open the valve equalizing the pressure differential within the BHA.

38. The method of claim 37 further comprising applying a second mechanical force in an uphole direction to retract the plurality of anchor slips.

* * * * *